US008025567B2

(12) United States Patent
Kane et al.

(10) Patent No.: US 8,025,567 B2
(45) Date of Patent: Sep. 27, 2011

(54) METHOD AND APPARATUS FOR CONDUCTING A GAME OF CHANCE

(75) Inventors: Steven N. Kane, Brookline, MA (US); Dow Hardy, Marlborough, MA (US); Mark E. Herrmann, Wellesley, MA (US); Bijan Sabet, Sudbury, MA (US)

(73) Assignee: GameLogic Inc., Waltham, MA (US)

( * ) Notice: Subject to any disclaimer, the term of this patent is extended or adjusted under 35 U.S.C. 154(b) by 1630 days.

(21) Appl. No.: 11/229,004

(22) Filed: Sep. 16, 2005

(65) Prior Publication Data

US 2006/0068876 A1 Mar. 30, 2006

Related U.S. Application Data

(63) Continuation-in-part of application No. 11/001,775, filed on Nov. 30, 2004.

(60) Provisional application No. 60/569,030, filed on May 7, 2004.

(51) Int. Cl.
*A63F 9/24* (2006.01)

(52) U.S. Cl. ..... 463/29; 463/16; 463/17; 463/18; 463/19; 463/20; 463/25

(58) Field of Classification Search ..... 463/16–20, 463/25, 29
See application file for complete search history.

(56) References Cited

U.S. PATENT DOCUMENTS 2,544,961 A 3/1951 Kemp
4,215,864 A 8/1980 Nichols
4,494,197 A 1/1985 Troy et al.
4,582,324 A 4/1986 Koza et al.
4,679,789 A 7/1987 Okada
4,689,742 A 8/1987 Troy et al.
4,725,079 A 2/1988 Koza et al.
4,764,666 A 8/1988 Bergeron
4,856,787 A 8/1989 Itkis
4,882,473 A 11/1989 Bergeron et al.
4,922,522 A 5/1990 Scanlon
5,158,293 A 10/1992 Mullins
5,324,035 A 6/1994 Morris et al.
5,351,970 A 10/1994 Fioretti
5,373,440 A 12/1994 Cohen
5,377,975 A 1/1995 Clapper, Jr.
5,398,932 A 3/1995 Eberhardt et al.
5,429,361 A 7/1995 Raven
(Continued)

FOREIGN PATENT DOCUMENTS

CA 2338080 9/2001
(Continued)

OTHER PUBLICATIONS

"Bejeweled Deluxe," Version 1.87, User Manual, PopCap Games, Inc., Release Date May 30, 2001, pp. 3-4.*
(Continued)

*Primary Examiner* — Omkar Deodhar
(74) *Attorney, Agent, or Firm* — Dority & Manning, P.A.

(57) ABSTRACT

A system and method are provided for playing a game of chance. The game of chance may include, for example, a lottery-type game. A result of the game of chance is revealed to a player in another medium. In one example, the result is revealed during multiple game instances of one or more online games. In one example, the online game includes a game similar to the well-known game of BEJEWELED.

33 Claims, 9 Drawing Sheets

U.S. PATENT DOCUMENTS

| | | | | |
|---|---|---|---|---|
| 5,445,391 | A | 8/1995 | Gleason, Jr. | |
| 5,518,253 | A | 5/1996 | Pocock et al. | |
| 5,569,082 | A | 10/1996 | Kaye | |
| 5,586,937 | A | 12/1996 | Menashe | |
| 5,611,729 | A | 3/1997 | Schumacher | |
| 5,628,684 | A | 5/1997 | Bouedec | |
| 5,645,485 | A | 7/1997 | Clapper, Jr. | |
| 5,653,635 | A | 8/1997 | Breeding | |
| 5,687,971 | A | 11/1997 | Khaladkar | |
| 5,709,603 | A * | 1/1998 | Kaye | 463/17 |
| 5,722,891 | A | 3/1998 | Inoue | |
| 5,749,784 | A | 5/1998 | Clapper, Jr. | |
| 5,768,382 | A | 6/1998 | Schneier et al. | |
| 5,772,511 | A | 6/1998 | Smeltzer | |
| 5,775,993 | A | 7/1998 | Fentz | |
| 5,779,549 | A | 7/1998 | Walker et al. | |
| 5,788,573 | A | 8/1998 | Baerlocher et al. | |
| 5,791,990 | A | 8/1998 | Schroeder et al. | |
| 5,791,991 | A | 8/1998 | Small | |
| 5,797,795 | A | 8/1998 | Takemoto | |
| 5,810,664 | A | 9/1998 | Clapper, Jr. | |
| 5,816,918 | A | 10/1998 | Kelly et al. | |
| 5,823,873 | A | 10/1998 | Moody | |
| 5,823,874 | A | 10/1998 | Adams | |
| 5,830,069 | A | 11/1998 | Soltesz et al. | |
| 5,848,932 | A | 12/1998 | Adams | |
| 5,860,653 | A | 1/1999 | Jacobs | |
| 5,871,398 | A | 2/1999 | Schneier | |
| 5,882,258 | A | 3/1999 | Kelly et al. | |
| 5,887,906 | A | 3/1999 | Sultan | |
| 5,928,082 | A | 7/1999 | Clapper, Jr. | |
| 5,944,606 | A | 8/1999 | Gerow | |
| 5,954,582 | A | 9/1999 | Zach et al. | |
| 5,980,385 | A | 11/1999 | Clapper | |
| 5,996,997 | A | 12/1999 | Kamille | |
| 6,007,426 | A | 12/1999 | Kelly et al. | |
| 6,012,983 | A | 1/2000 | Walker et al. | |
| 6,015,344 | A | 1/2000 | Kelly et al. | |
| 6,024,640 | A | 2/2000 | Walker et al. | |
| 6,028,920 | A | 2/2000 | Carson | |
| 6,044,135 | A | 3/2000 | Katz | |
| 6,048,269 | A | 4/2000 | Burns et al. | |
| 6,056,289 | A | 5/2000 | Clapper | |
| 6,059,289 | A | 5/2000 | Vancura | |
| 6,077,163 | A | 6/2000 | Walker et al. | |
| 6,106,393 | A | 8/2000 | Sunaga et al. | |
| 6,113,495 | A | 9/2000 | Walker et al. | |
| 6,146,272 | A | 11/2000 | Walker et al. | |
| 6,152,823 | A | 11/2000 | Lacoste et al. | |
| 6,159,097 | A | 12/2000 | Gura | |
| 6,162,121 | A | 12/2000 | Morro et al. | |
| 6,168,521 | B1 | 1/2001 | Luciano et al. | |
| 6,173,267 | B1 | 1/2001 | Cairns | |
| 6,179,711 | B1 | 1/2001 | Yoseloff | |
| 6,186,892 | B1 | 2/2001 | Frank et al. | |
| 6,193,608 | B1 | 2/2001 | Walker | |
| 6,203,011 | B1 | 3/2001 | Nulph et al. | |
| 6,203,427 | B1 | 3/2001 | Walker et al. | |
| 6,236,900 | B1 | 5/2001 | Geiger | |
| 6,241,606 | B1 | 6/2001 | Riendeau et al. | |
| 6,244,958 | B1 | 6/2001 | Acres et al. | |
| 6,251,017 | B1 | 6/2001 | Leason et al. | |
| 6,270,406 | B1 | 8/2001 | Sultan | |
| 6,273,817 | B1 | 8/2001 | Sultan | |
| 6,279,911 | B1 | 8/2001 | Cherry | |
| 6,280,325 | B1 | 8/2001 | Fisk | |
| RE37,371 | E | 9/2001 | Gerow | |
| 6,283,855 | B1 | 9/2001 | Bingham | |
| 6,287,197 | B1 * | 9/2001 | Dickinson et al. | 463/31 |
| 6,302,793 | B1 | 10/2001 | Fertitta et al. | |
| 6,309,298 | B1 | 10/2001 | Gerow | |
| 6,311,976 | B1 | 11/2001 | Yoseloff et al. | |
| 6,312,334 | B1 | 11/2001 | Yoseloff | |
| 6,358,151 | B1 | 3/2002 | Enzminger et al. | |
| 6,364,765 | B1 | 4/2002 | Walker et al. | |
| 6,364,766 | B1 | 4/2002 | Anderson | |
| 6,368,214 | B1 | 4/2002 | Luciano | |
| 6,368,218 | B2 | 4/2002 | Angell, Jr. | |
| 6,371,852 | B1 | 4/2002 | Acres | |
| 6,375,567 | B1 | 4/2002 | Acres | |
| 6,390,921 | B1 | 5/2002 | Busch et al. | |
| 6,394,902 | B1 | 5/2002 | Glavich et al. | |
| 6,402,614 | B1 | 6/2002 | Schneier et al. | |
| 6,439,995 | B1 * | 8/2002 | Hughs-Baird et al. | 463/20 |
| 6,471,208 | B2 | 10/2002 | Yoseloff et al. | |
| 6,488,280 | B1 | 12/2002 | Katz et al. | |
| 6,514,144 | B2 | 2/2003 | Riendeau et al. | |
| 6,523,829 | B1 | 2/2003 | Walker et al. | |
| 6,527,175 | B1 | 3/2003 | Dietz et al. | |
| 6,540,230 | B1 | 4/2003 | Walker et al. | |
| 6,565,084 | B1 | 5/2003 | Katz et al. | |
| 6,572,106 | B2 | 6/2003 | Alexoff et al. | |
| 6,572,107 | B1 | 6/2003 | Walker et al. | |
| 6,575,832 | B1 | 6/2003 | Manfredi et al. | |
| 6,582,307 | B2 | 6/2003 | Webb | |
| 6,582,310 | B1 | 6/2003 | Walker et al. | |
| 6,588,747 | B1 | 7/2003 | Seelig | |
| 6,595,854 | B2 | 7/2003 | Hughs-Baird | |
| 6,599,187 | B2 | 7/2003 | Gerow | |
| 6,599,192 | B1 | 7/2003 | Baerlocher et al. | |
| 6,607,439 | B2 | 8/2003 | Schneier et al. | |
| 6,612,501 | B1 | 9/2003 | Woll et al. | |
| 6,612,574 | B1 | 9/2003 | Cole et al. | |
| 6,619,660 | B2 | 9/2003 | Schaefer et al. | |
| 6,620,046 | B2 | 9/2003 | Rowe | |
| 6,625,578 | B2 | 9/2003 | Spaur et al. | |
| 6,645,074 | B2 | 11/2003 | Thomas et al. | |
| 6,645,075 | B1 | 11/2003 | Gatto | |
| 6,656,042 | B2 | 12/2003 | Reiss et al. | |
| 6,663,105 | B1 | 12/2003 | Sullivan et al. | |
| 6,676,126 | B1 | 1/2004 | Walker et al. | |
| 6,679,497 | B2 | 1/2004 | Walker et al. | |
| 6,681,995 | B2 | 1/2004 | Sukeda et al. | |
| 6,682,419 | B2 | 1/2004 | Webb et al. | |
| D486,869 | S | 2/2004 | Webb et al. | |
| 6,685,561 | B2 | 2/2004 | Anderson et al. | |
| 6,692,353 | B2 | 2/2004 | Walker et al. | |
| 6,705,944 | B2 | 3/2004 | Luciano | |
| 6,716,103 | B1 | 4/2004 | Eck et al. | |
| 6,719,631 | B1 | 4/2004 | Tulley et al. | |
| 6,729,956 | B2 | 5/2004 | Wolf et al. | |
| 6,733,385 | B1 | 5/2004 | Enzminger et al. | |
| 6,736,324 | B2 | 5/2004 | Behm | |
| 6,749,198 | B2 | 6/2004 | Katz et al. | |
| 6,761,633 | B2 | 7/2004 | Riendeau et al. | |
| 6,786,824 | B2 | 9/2004 | Cannon | |
| 6,811,484 | B2 | 11/2004 | Katz et al. | |
| 6,824,467 | B2 | 11/2004 | Schlottmann et al. | |
| 6,843,724 | B2 | 1/2005 | Walker et al. | |
| 6,852,031 | B1 | 2/2005 | Rowe et al. | |
| 6,855,052 | B2 | 2/2005 | Weiss et al. | |
| 6,866,584 | B2 | 3/2005 | Michaelson | |
| 6,896,619 | B2 | 5/2005 | Baltz | |
| 6,899,622 | B2 | 5/2005 | Lind et al. | |
| 6,910,968 | B2 | 6/2005 | Nassef et al. | |
| 6,913,534 | B2 | 7/2005 | DeFrees-Parrott | |
| 6,918,589 | B2 | 7/2005 | Thibault | |
| 6,929,544 | B2 | 8/2005 | Osterer | |
| 6,934,846 | B2 | 8/2005 | Szrek | |
| 6,942,570 | B2 | 9/2005 | Schneier et al. | |
| 6,969,319 | B2 | 11/2005 | Rowe et al. | |
| 7,008,317 | B2 | 3/2006 | Cote et al. | |
| 7,008,318 | B2 | 3/2006 | Schneier et al. | |
| 7,024,375 | B2 | 4/2006 | Chau | |
| 7,052,394 | B2 | 5/2006 | Walker et al. | |
| 7,073,720 | B2 | 7/2006 | Behm | |
| 7,094,149 | B2 | 8/2006 | Walker | |
| 7,112,135 | B2 | 9/2006 | Anderson | |
| 7,118,478 | B2 | 10/2006 | Fayter et al. | |
| 7,163,459 | B2 | 1/2007 | Tanskanen et al. | |
| 7,172,506 | B2 | 2/2007 | Baerlocher et al. | |
| 7,179,168 | B1 | 2/2007 | Tulley et al. | |
| 7,186,180 | B2 | 3/2007 | Lathrop | |
| 7,213,811 | B2 | 5/2007 | Bozeman | |
| 7,241,219 | B2 | 7/2007 | Walker | |
| 7,275,990 | B2 | 10/2007 | Walker et al. | |
| 7,285,045 | B2 | 10/2007 | Schneier et al. | |

| | | | |
|---|---|---|---|
| 7,294,058 | B1 | 11/2007 | Slomiany et al. |
| 7,303,468 | B2 | 12/2007 | Schneier et al. |
| 7,303,470 | B2 | 12/2007 | George et al. |
| 7,311,599 | B2 | 12/2007 | Knapp |
| 7,357,393 | B2 | 4/2008 | Finocchio |
| 7,416,484 | B1 | 8/2008 | Nelson |
| 7,490,830 | B2 | 2/2009 | Mirandette |
| 2001/0034635 | A1 | 10/2001 | Winters |
| 2001/0046891 | A1 | 11/2001 | Acres |
| 2001/0049305 | A1 | 12/2001 | Riendeau et al. |
| 2002/0010015 | A1 | 1/2002 | Acres |
| 2002/0013167 | A1 | 1/2002 | Spaur et al. |
| 2002/0039923 | A1 | 4/2002 | Cannon et al. |
| 2002/0042300 | A2 | 4/2002 | Acres et al. |
| 2002/0052229 | A1 | 5/2002 | Halliburton et al. |
| 2002/0061778 | A1 | 5/2002 | Acres |
| 2002/0077173 | A1 | 6/2002 | Luciano et al. |
| 2002/0090986 | A1 | 7/2002 | Cote et al. |
| 2002/0090987 | A1 | 7/2002 | Walker et al. |
| 2002/0093190 | A1 | 7/2002 | Katz |
| 2002/0098882 | A1 | 7/2002 | Lind et al. |
| 2002/0107072 | A1 | 8/2002 | Giobbi et al. |
| 2002/0147040 | A1 | 10/2002 | Walker et al. |
| 2002/0152120 | A1 | 10/2002 | Howington et al. |
| 2002/0155885 | A1 | 10/2002 | Shvili |
| 2002/0169018 | A1 | 11/2002 | Schneier et al. |
| 2002/0187827 | A1 | 12/2002 | Blankstein |
| 2002/0193158 | A1 | 12/2002 | Weiss et al. |
| 2002/0198038 | A1 | 12/2002 | Adams |
| 2003/0013531 | A1 | 1/2003 | Rowe et al. |
| 2003/0027628 | A1 | 2/2003 | Luciano |
| 2003/0032473 | A1 | 2/2003 | Rowe et al. |
| 2003/0032476 | A1 | 2/2003 | Walker et al. |
| 2003/0045340 | A1 | 3/2003 | Roberts |
| 2003/0047869 | A1 | 3/2003 | Walker et al. |
| 2003/0060257 | A1 | 3/2003 | Katz et al. |
| 2003/0060261 | A1 | 3/2003 | Katz et al. |
| 2003/0069068 | A1 | 4/2003 | Kaminkow |
| 2003/0080508 | A1 | 5/2003 | Thibault |
| 2003/0102625 | A1 | 6/2003 | Katz et al. |
| 2003/0114217 | A1 | 6/2003 | Walker et al. |
| 2003/0119581 | A1 | 6/2003 | Cannon et al. |
| 2003/0139214 | A1 | 7/2003 | Wolf et al. |
| 2003/0155715 | A1 | 8/2003 | Walker et al. |
| 2003/0157977 | A1 | 8/2003 | Thomas et al. |
| 2003/0171986 | A1 | 9/2003 | Itkis et al. |
| 2003/0176210 | A1 | 9/2003 | Vancura et al. |
| 2003/0176212 | A1 | 9/2003 | Schlottmann et al. |
| 2003/0184012 | A1 | 10/2003 | Green |
| 2003/0186739 | A1 | 10/2003 | Paulsen et al. |
| 2003/0195841 | A1 | 10/2003 | Ginsberg et al. |
| 2003/0199318 | A1 | 10/2003 | Nassef et al. |
| 2003/0218303 | A1 | 11/2003 | Walker et al. |
| 2003/0220138 | A1 | 11/2003 | Walker et al. |
| 2004/0025190 | A1 | 2/2004 | McCalla et al. |
| 2004/0036212 | A1 | 2/2004 | Walker et al. |
| 2004/0038723 | A1 | 2/2004 | Schneier et al. |
| 2004/0051240 | A1 | 3/2004 | Adams |
| 2004/0053683 | A1 | 3/2004 | Hartl et al. |
| 2004/0059445 | A1 | 3/2004 | Moore |
| 2004/0063484 | A1 | 4/2004 | Dreaper et al. |
| 2004/0092307 | A1 | 5/2004 | George et al. |
| 2004/0102238 | A1 | 5/2004 | Taylor |
| 2004/0102239 | A1 | 5/2004 | Samila |
| 2004/0127279 | A1 | 7/2004 | Gatto et al. |
| 2004/0133472 | A1 | 7/2004 | Leason et al. |
| 2004/0142741 | A1 | 7/2004 | Walker et al. |
| 2004/0147308 | A1 | 7/2004 | Walker et al. |
| 2004/0152504 | A1 | 8/2004 | Herrmann et al. |
| 2004/0152510 | A1 | 8/2004 | Herrmann |
| 2004/0180722 | A1 | 9/2004 | Giobbi et al. |
| 2004/0185930 | A1 | 9/2004 | Thomas et al. |
| 2004/0204222 | A1 | 10/2004 | Roberts |
| 2004/0214628 | A1 | 10/2004 | Boyd et al. |
| 2004/0229671 | A1 | 11/2004 | Stronach et al. |
| 2004/0229677 | A1 | 11/2004 | Gray |
| 2004/0259629 | A1 | 12/2004 | Michaelson et al. |
| 2004/0259631 | A1 | 12/2004 | Katz et al. |
| 2005/0037841 | A1 | 2/2005 | de Waal |
| 2005/0049042 | A1 | 3/2005 | Walker et al. |
| 2005/0075158 | A1 | 4/2005 | Walker et al. |
| 2005/0090314 | A1 | 4/2005 | Nassef, Jr. et al. |
| 2005/0092839 | A1 | 5/2005 | Oram |
| 2005/0124407 | A1 | 6/2005 | Rowe et al. |
| 2005/0164779 | A1 | 7/2005 | Okuniewicz |
| 2005/0170881 | A1 | 8/2005 | Muskin |
| 2005/0187005 | A1 | 8/2005 | Rose et al. |
| 2005/0258596 | A1 | 11/2005 | Such |
| 2005/0282619 | A1 | 12/2005 | Vancura et al. |
| 2005/0282626 | A1 | 12/2005 | Manfredi et al. |
| 2005/0288088 | A1 | 12/2005 | Englman et al. |
| 2006/0025219 | A1 | 2/2006 | Nassef, Jr. et al. |
| 2006/0035696 | A1 | 2/2006 | Walker et al. |
| 2006/0036450 | A1 | 2/2006 | Nassef, Jr. et al. |
| 2006/0041586 | A1 | 2/2006 | Nassef, Jr. et al. |
| 2006/0068893 | A1 | 3/2006 | Jaffe et al. |
| 2006/0073884 | A1 | 4/2006 | Walker et al. |
| 2006/0089194 | A1 | 4/2006 | Joshi et al. |
| 2006/0148562 | A1 | 7/2006 | Walker et al. |
| 2006/0194631 | A1 | 8/2006 | Rowe et al. |
| 2006/0205511 | A1 | 9/2006 | Thomas et al. |
| 2006/0247035 | A1 | 11/2006 | Rowe et al. |
| 2007/0054729 | A1 | 3/2007 | Hornik et al. |
| 2007/0060261 | A1 | 3/2007 | Gomez et al. |
| 2007/0060274 | A1 | 3/2007 | Rowe et al. |
| 2007/0060317 | A1 | 3/2007 | Martin et al. |
| 2007/0060329 | A1 | 3/2007 | Martin et al. |
| 2007/0060330 | A1 | 3/2007 | Martin et al. |
| 2007/0060331 | A1 | 3/2007 | Martin et al. |
| 2007/0060369 | A1 | 3/2007 | Martin et al. |
| 2007/0087834 | A1 | 4/2007 | Moser et al. |
| 2007/0167216 | A1 | 7/2007 | Walker et al. |
| 2007/0173322 | A1 | 7/2007 | Swamy et al. |
| 2007/0265062 | A1 | 11/2007 | Thomas et al. |
| 2008/0032763 | A1 | 2/2008 | Giobbi et al. |
| 2008/0039171 | A1 | 2/2008 | Slomiany et al. |
| 2008/0039173 | A1 | 2/2008 | Walther et al. |
| 2008/0287176 | A1 | 11/2008 | Bennett |

FOREIGN PATENT DOCUMENTS

| | | | |
|---|---|---|---|
| EP | 1746550 | A2 | 1/2007 |
| EP | 1762990 | A2 | 3/2007 |
| EP | 1833014 | A1 | 9/2007 |
| WO | WO 91/06931 | | 5/1991 |
| WO | WO 97/37737 | | 10/1997 |
| WO | WO 99/10057 | | 3/1999 |
| WO | WO 99/16519 | | 4/1999 |
| WO | WO 00/43087 | | 7/2000 |
| WO | WO 00/69535 | | 11/2000 |
| WO | WO 01/14029 | | 3/2001 |
| WO | WO 03/004118 | | 1/2003 |
| WO | WO 03/061795 | | 7/2003 |
| WO | WO 03/084625 | | 10/2003 |
| WO | WO 03/089077 | | 10/2003 |
| WO | WO 03/089082 | | 10/2003 |
| WO | WO 2004/013820 | | 2/2004 |
| WO | 2004/105902 | | 9/2004 |
| WO | 2004105902 | A1 | 12/2004 |
| WO | WO 2004/114073 | | 12/2004 |
| WO | WO 2005/029279 | | 3/2005 |
| WO | WO 2005/031666 | | 4/2005 |
| WO | WO 2005/079242 | | 9/2005 |
| WO | WO 2006/028820 | | 3/2006 |
| WO | WO 2006/052469 | | 5/2006 |
| WO | WO 2007/035618 | | 3/2007 |
| WO | WO 2007/040707 | | 4/2007 |
| WO | WO 2007/076321 | | 7/2007 |
| WO | WO 2007/145999 | | 12/2007 |
| WO | WO 2008/014334 | | 1/2008 |
| WO | WO 2008/022083 | | 2/2008 |
| WO | WO 2008/022084 | | 2/2008 |

OTHER PUBLICATIONS

Rules of Pai Gow Poker. Casino City. Dec. 3, 2000. Online: http://web.archive.org/web/20001203170300/http://www.casinocity.com/rules/paigow.htm.

H.X. Mel and Doris Baker, Cryptography Decrypted, 2001 Addison Wesly, chapters 9 to 12.

Virginia Lottery games, downloaded from www.archive.org, Apr. 29, 2007.
Pop Cap Games, Bejeweled, Feb. 3, 2005, http://web.archive.org/web/20050203202244/http://www.go2share.net/game/bejeweled/index.htm.
John Scarne, Scarne's Complete Guide to Gambling, 1961, Simon & Schuster, New York, chapter 4 on lotteries, pp. 125-126.
Wikipedia, "Wheel of Fortune (US Game Show)" Wikipedia, Nov. 13, 2007 <http://en.wikipedia.org/wiki/Wheel_of Fortune_%28US_game_show%29>.
New Jersey, State of, "Wheel of Fortune" New Jersey Lottery, Nov. 13, 2007 <http://www.state.nj.us/lottery/instant/ig409.htm>.
New Jersey, State of, "Lots O' Spots Bingo" New Jersey Lottery, Dec. 6, 2007 <http://www.state.nj.us/lottery/instant/ig340.htm>.
http://www.powerball.com/powerball/pb_howtoplay.asp, accessed Sep. 14, 2008, All.
Written opinion of the international searching authority (international application No. PCT/US07/76224).
Examiner's first report on patent application No. 2003298941.
Bejeweled Deluxe, Version 1.87, Developed and published by PopCap Games, Inc., www.popcap.com, http://www.popcap.com/faq/bejeweled/1033/pc/readme.html (1 of 8) Feb. 25, 2010 9:14:22 AM.
David, Matthew, Online Games Development in Flash—A Brief History, Apr. 28, 2003, SitePoint, http://articles.sitepoint.com/print/flash-brief-history (1 of 6) Jun. 18, 2010 8:28:50 AM.

* cited by examiner

METHOD AND APPARATUS FOR CONDUCTING A GAME OF CHANCE

RELATED APPLICATIONS

This application is a continuation-in-part of and claims priority under 35 U.S.C. §120 to U.S. application Ser. No. 11/001,775, filed Nov. 30, 2004, entitled "METHOD AND APPARATUS FOR CONDUCTING A GAME OF CHANCE," which claims priority under 35U.S.C. §119(e) to U.S. Provisional Application Ser. No. 60/569,030, entitled "METHOD AND APPARATUS FOR CONDUCTING A GAME OF CHANCE," filed on May 7, 2004. Each of these applications is incorporated herein by reference in its entirety.

FIELD OF THE INVENTION

The field of the invention relates generally to lotteries and gaming, and more particularly, to systems and methods for conducting lottery-based games or casino-based gaming.

BACKGROUND

There are many different types of games that involve the issuance of a lottery ticket to play a game of chance. Lottery tickets are sold through retailers using machines referred to as point of sale (POS) terminals. These tickets are generally printed at the POS terminal, and are usually issued for some lottery drawing to be performed at a later time. Examples of these types of lottery games of chance include traditional state lottery drawings and multi-state lottery drawings (e.g., PowerBall). Another type of lottery ticket, referred to in the art as instant lottery, includes a pre-printed scratch-type lottery ticket which includes a latex or similar coating that is scratched off by a purchaser (a player), revealing one or more game indicia that determine whether or not the player won the game or series of games as indicated on the ticket. The indication is generally "instant" in that the player knows, when they scratch off the ticket coating, whether or not they won the game.

In addition, there are many online games that can be played using a computer system coupled to a communication network (e.g., the Internet). These games may include traditional games of chance, games of skill, and casino-type games, among others.

Some systems combine lottery-type games and online games. In one such system, a lottery ticket is sold to a player, who then plays a further game using a computer system. In such a game system, the ticket sold to a player includes a code which is correlated to a game seed stored in a computer system upon which a computer game is played. The computer game determines the correlated game seed, and this game seed is mapped to a series of predetermined game states that lead to a predetermined outcome. That is, the code stored on the ticket includes the outcome. In another type of system, the code stored on the ticket is an encoded form of the lottery result, which is then revealed to the player at the end of play of an online game.

SUMMARY

New and more interesting game formats are needed for lottery and casino type games that keep players' interest and therefore result in continued and/or return players. According to one embodiment of the present invention, it is appreciated there is a great deal of effort and expense to introduce additional games, especially in the casino area. In particular, as each game is introduced, its features are scrutinized by regulators prior to introduction. It therefore would be beneficial to be able to reduce the regulatory effort in introducing new games that are exciting to players to play. To this end, according to one aspect of the present invention, a system is provided having two games, a first one of which is already approved by regulators the outcomes of which are used to drive outcomes of a second game. Because the outcome determination and odds of winning the second game are driven by a previously-approved game, the regulatory hurdles associated with releasing the second game are reduced.

In one aspect, the player is permitted to play a game that may be similar to the well-known game of BEJEWELED (BEJEWELED is a trademark of Pop Cap Games, Inc., Seattle, Wash.) and its variations. As is known, BEJEWELED is a game of skill that allows the player to earn points by removing elements (e.g., gemstones) from a game grid. BEJEWELED and similar games involve a window having a grid having elements where new elements are fed into the grid to replace elements that are removed. Groups of three or more matching elements are removed from the grid when the elements appear adjacent in a row or column of the grid (e.g., a linear group of matching elements appear in consecutive locations in the row or column). The player may be permitted to play the game of BEJEWELED (or similar game), during which the result of the game is revealed over one or more instances of the BEJEWELED-type game.

According to one aspect of the present invention, an intermediate result (e.g., a prize or portion thereof) may be associated with an element appearing in the game grid of a BEJEWELED-type game. According to one embodiment, the intermediate result may be displayed to the player when the element associated with the intermediate result is removed from the game grid during play of the BEJEWELED-type game. For instance, the result may be revealed when the element associated with the intermediate result is removed from the grid. Such removal may occur, for example, as a result of achieving a grouping of three or more linearly-arranged elements in a row or column.

According to one embodiment, there may be more than one intermediate result associated with a single element of the grid. Further, there may be more than one element of the grid associated with an intermediate result. Such an association between an element and an intermediate result may be indicated, for example, to the player. In one particular example, the association between an element and a result (e.g., a prize) is indicated graphically in the game interface. Such elements may share one or more characteristics with other "normal" elements of the grid, that, when arranged in a linear grouping of three or more similar elements, the grouping of elements is removed from the grid.

According to one aspect, a ticket associated with the BEJEWELED-type game provides for the player to play the BEJEWELED-type game. In one embodiment, the ticket is associated with one or more instances of the BEJEWELED-type game, and one or more results of the BEJEWELED-type game. Each game instance may be associated with one or more intermediate results, for example, prizes, money, points or other rewards. In one embodiment, a complete result of a game instance or a plurality of game instances includes one or more of the intermediate results. In another embodiment, the one or more results of the BEJEWELED-type game are independent of the one or more intermediate results (e.g., points) awarded during the play of one or more game instances.

In one aspect of the present invention, the player is permitted to play the BEJEWELED-type game or another game (referred to hereinafter as a "primary" game) during which the game playing system reveals results of yet another game (referred to hereinafter as a "secondary" game). This secondary game may be a casino or lottery-based game and, according to one embodiment, this secondary game is already approved by regulators. One such game is the well-known game of Keno. However, it should be appreciated that the secondary game may be any other type of game (e.g., a lottery game). The primary game may be any type of computer-based game, including games of skill and/or chance, such as card games, casino games, video games or any other type of game through which a result from another game may be revealed. In one aspect of the present invention, the play of the primary game that the player plays does not affect the outcome of the secondary game. In another aspect of the present invention, the secondary game result does not affect the outcome of the primary game played by the player.

In one example, the primary game involves some level of influence by the player on the outcome of the primary game. For example, the primary game may be a game of skill. However, it should be appreciated that the primary game be a game based on chance, or to combination of skill and chance.

According to one embodiment of the present invention, the BEJEWELED-type game is combined with a second level game. Play of the second level game may proceed after some achievement level in the BEJEWELED-type game. For example, points or items may be awarded in the BEJEWELED-type game, and in one embodiment, the second level may proceed after the player achieves a particular point total as further discussed below. Alternatively, the player may play the BEJEWELED-type game until completion, and at the end of the BEJEWELED-type game, the player begins playing the second level game.

It is to be appreciated, however, that the invention is not limited to the primary game being a BEJEWELED-type game but rather any other computer-based game may be used as the primary game. For instance, there are other games similar in function to the BEJEWELED game that may be used. Other grid-based element removal games may be used as the primary game. For example, the primary game may be the well-known game of COLLAPSE (COLLAPSE is a trademark of Game House, Inc., Seattle, Wash.) and its variations. In addition, it is to be understood that the term "online" game as used herein is intended to refer to any type of computer-based game including, but not limited to, games that may be played over a network connection such as the Internet.

The secondary game may be any type of game and in one preferred embodiment may be a game of chance such as a ticket-based lottery-type game, or another game such as the well-known games of Keno, Bingo or Bonanza-Bingo. For clarity, the secondary game may be referred to herein as a "ticket game" however, it is to be appreciated that the secondary game may also be implemented using a game piece that is not a ticket.

According to one embodiment, the secondary game may be a ticket game associated with a scratch or pull-tab ticket. It is appreciated that the term "pull-tab ticket" may be used herein to refer generally to tickets that conceal aspects of the ticket's game, including but not limited to pull-tab tickets, scratch tickets and other types of game pieces.

According to one aspect of the present invention, the result of the primary game is stored on a server coupled to a computer system upon which the game is played. In one example, the result is downloaded to the computer system prior to game play. The result may be in the form of intermediate results of each game instance that are displayed to the player at various points during game play. For instance, intermediate results may be displayed to a user during an instance of a BEJEWELED-type game.

In one embodiment of the present invention, the traditional game of BEJEWELED or similar game is coupled with a second level game. Further, during the play of the BEJEWELED-type game, one or more items are awarded to the player for use in the second level game. For instance, items are awarded when particular one(s) of the elements are removed from the grid. In the example of the BEJEWELED-type game, there may be an indication that one or more of the elements of the grid contains an item (e.g., one that may be used with a second level game). This indication may be, for example, a graphical, textual, or other symbolic indication that the element contains an item. In one example, this indication may be the same or similar element used to indicate that there is a hidden item associated with the element. The type of hidden item may not, according to one embodiment, be known by the user until the hidden item is revealed during game play. In one example, when the element having the hidden item is selected (or removed from the grid), the game program displays the item to the player.

In another example, the grid may contain more than one hidden item, and these items may be collected by the player as hidden items are revealed. When the game has ended, the player may use the one or more collected items in the second level game. In one example game, the items revealed during the game of BEJEWELED are used to open hidden items in a second level game. For instance, the second level game includes a series of safes (or other element type) which are opened (and their hidden items revealed) with items collected during the play of the BEJEWELED-type game. In one example, the items are representations of sticks of dynamite that are used by the user to open the safe. However, it should be appreciated that the items may be any type of item that can be used in a second level game.

Alternatively, or in addition to operating a second level game, prizes may be revealed with elements in the first level game. As elements having associated prizes are removed from the grid, the associated prizes are revealed. The BEJEWELED-type game may or may not have a second level associated with it, and prizes may be revealed in the first and/or second level.

Hidden items revealed during the first and/or second level of play may be, for example, a cash prize awarded for a particular game. It should be appreciated, however, that other prizes may be awarded (e.g., merchandise, credit, free play, etc.) and that the invention is not limited to any particular prize type.

According to one aspect of the present invention, prizes revealed during the first and/or second level game may be stored in a database of the server and downloaded to the client prior to play. In this example, the player may be allowed, when a ticket is purchased at a POS, the ability to play a number of instances of the game. Prizes may be awarded, for example, as elements are removed during play of the BEJEWELED-type game, at each instance of the second level of the online game, or at any other point. To this end, the result of each prize may be stored in the database of the server, and may be indexed by an identifier of the ticket. For example, the identifier may be a serial number or other ticket-identifying information.

According to one aspect of the present invention, prizes are only awarded in the second level game. In another example, after a prize is revealed (or not) in the second level game, the player is permitted to play any remaining instances of the primary game (e.g., a slot-machine type game or BEJEW- ELED-type game). According to another embodiment, the player may not be permitted to replay game instances after they have been played. To this end, a game-playing system may maintain a status of the game instances played by the player. The game-playing system may maintain other information, such as game play information, how prizes are revealed to the player, and other information that may be useful for assessing or auditing game play and playing experiences of the player.

Each instance of the game may include an associated prize (or not), and these prizes may be combined for an overall prize associated with the ticket. In one example, the prize associated with the first instance of the BEJEWELED-type game and its second level is $10.

Each instance of the game may include an associated prize (or not), and these prizes may be combined for an overall prize associated with the ticket. In one example, the prize associated with the first instance of the BEJEWELED-type game and its second level is $10. A prize associated with a second instance of the BEJEWELED-type game and its second level is $15. The prizes associated with each instance of the BEJEWELED-type game and its second level may be stored as an entry in the database of the server.

Alternatively, the result of each prize for each instance of the game may be determined dynamically by the client computer. For example, if the overall prize (e.g., $25) for the ticket is known, the client can determine (e.g., randomly) a distribution of winnings of the overall prize among game instances. In the example above, a play of the ticket on one computer could award a $25 prize among two game instances as follows: $5 prize for the first game instance and $20 for the second game instance. Another play of the ticket on the same or different computer may award a $25 prize differently among the two game instances (e.g., $10 for the first game instance, $15 for the second game instance, etc.). It should be appreciated, however, that the game may include any number of game instances, and the prize associated with each game instance may be stored in any storage location (e.g., at the client computer, at the server, etc.).

In another example system, prizes may be awarded in association with each item collected in the game (e.g., a stick of dynamite in a BEJEWELED-type game). Therefore, prizes may be distributed among hidden items in the game grid as well as being distributed among game instances. As discussed, prize distribution may be stored in a database of the server, may be determined by the client (e.g., randomly), or may be stored at any location or be determined by any manner by the client.

According to another aspect of the present invention, an improved game experience is provided for revealing the result of an online game. As discussed above, a player purchases a ticket or other game piece at a POS or other location. On the ticket, multiple plays of an associated online game are provided with each ticket or other game piece. The player can play those multiple plays across a set of games. For instance, the set of games may include, for example, games of skill and/or chance as discussed above. Certain games may include one or more attempts (or opportunities) for winning prizes. These opportunities for winning may be associated with one or more prizes. For example, a player playing a slot machine may be awarded a certain number of opportunities to play a game (e.g., a game instance (or game play) or other opportunity to win a prize when playing a particular game instance). In the case of a slot machine game, the player may be given a particular number of spins of the slot machine game, and, as a result of each spin, the player may be awarded (or not) a prize. In one embodiment, the result of the overall game is predetermined, and a game experience is determined for each opportunity (e.g., spin) that results in a contribution to the result of the overall game.

According to one embodiment of the present invention, the type of game that is played is immaterial to the outcome revealed to the player. More particularly, the same outcomes associated with a particular ticket may be used to drive multiple types of games. This allows, for example, the gaming operator to offer multiple types of games with a single ticket, and allows the player to select which game(s) to play to reveal the outcomes associated with the particular ticket. For instance, the player may elect to play a slot machine game for a first game instance of a ticket, and for a second instance, play a BEJEWELED-type game. Of course, it should be appreciated that any type of game and other combinations of games are possible. In this manner, the player may be provided the flexibility to play particular games in which the player is interested, thereby increasing his/her interest and participation in the game. Further, the game operator is provided additional flexibility as new games may be introduced/substituted that are associated with the same ticket or other game piece.

According to one embodiment of the present invention, the outcome of the game is predetermined at the time of ticket printing, issuance, or purchase or shortly thereafter. That is, the game outcome associated with a particular ticket is available prior to, at the same time, or shortly thereafter the ticket is provided to the player, after which time the player is permitted to play any games to reveal the predetermined outcome. In another embodiment, outcomes associated with tickets issued to the player are determined some time after the ticket issuance (i.e., outcomes are "post-determined"). Such is the case with Keno or other drawing-based games wherein game outcomes are determined after ticket issuance. In such a game, players are permitted to obtain the outcome at a predetermined time, usually after the player has purchased the ticket. In one aspect of the invention, it may be beneficial to have a later activation of tickets, especially in the case of a ticket-based game where tickets are issued in some other gaming environment (e.g., a casino). It may be desirable to only permit the player to play such a game outside the gaming environment so as not to compete with other games. Additionally, it may be desirable to require the player to revisit the gaming environment to redeem the ticket and increase the chances that the player will purchase additional tickets or play other types of games offered in the gaming environment.

Also, according to another aspect of the present invention, a first game may be used to reveal the result of a second game. As discussed above, this second game may be one which is already approved by regulators. Such a system may be, for example, a game whose results are driven by a random number generator (or RNG as referred to in the art, such as the games of Keno, Bingo, and Bonanza-Bingo, or it may be a lottery-type game associated with, for example, scratch-and-win tickets). Other games may be used to drive the result of an online game.

In one example, a Keno game and its associated system are used to generate results which are revealed to a player during play of an online game. To this end, a Keno-based system may be used in conjunction with an online gaming system to present new and interesting online games whose outcomes are driven by results provided by the Keno system. In one particular example, a Keno system provides a correlation of a ticket identifier to a Keno game which is held at some predetermined time. As the Keno numbers are drawn, an outcome is produced that is associated with the particular ticket identifier and is provided to an online gaming system. The online gaming system uses the produced outcome to render a new and interesting gaming experience within an online gaming environment. As discussed, such an environment may include online play of one or more online games of skill, chance, or combination thereof.

According to one embodiment of the present invention, wins are optimized across game instances associated with a ticket. For instance, a ticket may have a predetermined outcome (for example, awarding a prize of $50), that may be allocated across the game instances associated with that ticket. For example, in the case of winning $50 on a 5-play (5 game instances) ticket, it may be desired to allocate the wins across game instances to provide a particular game experience. For instance, the game experience of winning $50 may be distributed across five game instances (e.g., five separate games, respectively winning $5, $0, $0, $5, $40) to provide the player an early indication of winning. Also, the remaining game play of the game instances may be scripted to build the drama of the game experience while still retaining player interest. Such a scripted outcome is more interesting, according to one embodiment, as the player is presented an outcome in a way such that retains interest in the game. This is beneficial, as an overall result includes extending scratch-type games or other type of game experience beyond the point of sale, and beyond the instant (but fleeting) gratification associated with scratch-type or other instant ticket game experiences.

According to one embodiment, a player is permitted to wager and redeem bets at authorized locations (e.g., legal jurisdictions such as lottery retail establishments, casinos, and the like) while the online portion of the game may be played in any locale or jurisdiction. In such a case, the casino or lottery experience is extended to locations where otherwise lottery and/or casino games are not available. Thereafter, players return to the lottery or casino establishment to redeem their tickets thereby providing yet another opportunity to entertain the player.

According to yet another aspect of the present invention, winning results may be split across opportunities to win. One embodiment of the present invention relates generally to the manner in which wins are shown to the player across win opportunities. In one specific example, one embodiment relates to a method for revealing wins to a player across a play of multiple game instances that build excitement for the player and which holds the interest of the player in continuing to play the game. It is appreciated that the game experience may be made more compelling if wins are distributed among win opportunities in an interesting way.

Another method for maintaining the interest of players includes awarding additional opportunities to win with each ticket. For example, one of the prizes awarded with a particular opportunity to win (e.g., during the play of the game instance) may be one or more additional opportunities to win. For example, in a slot machine game, an issued ticket may be associated with five (5) spins. One of the prizes awarded with the ticket may include additional spins. At the time of initial ticket activation, it may be predetermined that the ticket is associated with these additional opportunities to win, and these additional opportunities may be associated with the issued ticket. The player, when playing the game, will obtain additional satisfaction in playing because the number of game instances to be played by the player are increased, and therefore, their opportunity to win is also increased. This may be beneficial to create a more realistic gaming experience (such as in casino slots) where additional spins may be awarded during casino play. However, unlike casino play wherein slot play can be continued from an online account or by placing additional bets to create a more continuous game experience, the additional spins are awarded to a single ticket.

In the case where an online game system is a Keno-based or other drawing-based systems wherein results are not predetermined, additional opportunities to win may be associated with the ticket in the form of additional numbers selected by a computer system and associated with the ticket at the time of a drawing. This may be performed, for example, by assigning one or more additional drawing entries as a prize itself in the pay table associated with the Keno or other drawing-based game. More particularly, the drawing entries may be awarded as prizes, which themselves are indexes into other entries in the same pay table. Such additional entries may correspond to one or more prizes. For example, when the drawing occurs, the additional plays are awarded to the drawing numbers associated with the ticket. These drawing numbers may be associated with a particular game instance, of which there may be many associated with one ticket. At the point when the ticket is activated by the result of the drawing and play of the online game is permitted, the player, upon the beginning of play of the ticket or a particular game instance, the player is awarded the additional plays (and therefore, any prizes) associated with these additional plays. The additional plays may be played as additional game instances, which themselves have additional reveal opportunities. Alternatively, additional reveal opportunities may be added to one or more other game instances to make game play more exciting.

In another example, additional opportunities to win are awarded to a ticket, but these additional opportunities are awarded for a future game instance. In one example, the game reveals, during a win opportunity (e.g., a spin, a reveal, etc.) in a first game instance, one or more win opportunities within a second game instance. These win opportunities may be redeemed and "added on" to the second game instance, or the win opportunities may be provided as part of a "free play" of an additional game instance. In the case of a game driven by a drawing-based system (e.g., Keno, bingo, etc.), additional win opportunities may be provided for game instances conducted at a later time. For example, in a first game, a player may be provided a "free play" of a game instance to be conducted (or available to be played) at a particular start time. To this end, the player may be provided an additional code that allows the player to play the game at the later time. In the case of a subscription-based system where a player subscribes to play more than one game, the player may have additional plays added to his/her existing subscription.

In another example, an additional opportunity to win a prize may be provided outside of the play of the primary game. Because the opportunity is presented outside of the play of the game, there are several benefits to such a win opportunity. For instance, the player is permitted to lose the primary game even though the ticket associated with the primary game is a winning ticket. In one specific example, the player may be permitted to play the primary game and lose, and have the winning result revealed in the additional win opportunity. Thus, a wider range of games and more realistic games may be offered with such a game format. In one embodiment, the additional win opportunity may be presented to the player in the form of an additional game. In one specific game format, a number selection game may be used as the additional game.

Also, providing such an additional win opportunity allows the primary game to be simplified, as the various permutations of possible results of the primary game need not be designed into the primary game. For instance, a paytable associated with the primary game may not adequately represent all of the possible combinations of game outcomes that may produce a predetermined win result. Thus, the additional win opportunity may be provided to take into account any game outcomes that fall outside of the paytable. Further, the additional win opportunity may be used by a game operator to award prizes to the player outside play of to the primary game. For instance, the game operator or affiliated organization may provide, in the additional win opportunity, additional prizes such as, for example, rewards points, coupons, discounts or other promotional items. These items may be awarded with the intent of increasing interest in the game and/or promoting other games, products, and/or services.

In another aspect of the present invention, winnings by a player may be redeemed online to allow the player to play further instances of the online game. For instance, the player, after receiving a prize when playing a particular game instance, is permitted to redeem the prize online. In one type of online redemption, the player is provided one or more additional game instances to be played. To this end, the player may be provided one or more access codes allowing the player to play the additional game instance(s). These additional access codes may be provided to the player in an interface of the game, by e-mail, or other method.

According to another aspect of the present invention, a method is presented for providing players an enhanced gaming experience. According to one embodiment, it is appreciated that it is beneficial to enhance players' interest in playing games, particularly losing ones. In one embodiment, an illusion is presented to players to provide the illusion of being very close to winning a particular game. For instance, in the case of a slot machine, the slot machine result may indicate, in a three-wheel slot machine, that the player received a possible winning combination on the first two wheels, and only with the revealing of the last wheel does the player realize that he/she has lost the game. According to one aspect, it is realized that the losing game experience should compel the player to continue playing the game.

In another example system, prizes may be awarded in association with each item collected in the game (e.g., number of points in a slot machine type game). Therefore, prizes may be distributed among elements or levels during play as well as being distributed among game instances. As discussed, prize distribution may be stored in a database of the server, may be determined by the client (e.g., randomly), or may be stored at any location or be determined by any manner by the client.

According to another aspect of the invention, it is appreciated that conventional methods for playing online games of chance are not secure. In particular, because the result or outcome of the game or predetermined sequence of game states may be encoded on a ticket, the lottery game may be compromised if the winning codes are deciphered. Such a deciphering could occur, for example, by hacking a computer system associated with the online lottery and obtaining a list of winning tickets, or reverse engineering software (e.g., on a PC) where the winning codes or sequence of game states may be stored. Further, it is realized that in such conventional systems, the lottery ticket or the online game software and its data are single points of security failures in the system.

One aspect of the present invention relates to a method for conducting a game of chance. According to one embodiment, a more secure method is provided by which an online game may be played. Instead of placing a game seed that determines a sequence of game states on a ticket (e.g., an instant scratch or lottery ticket), the game states or outcomes may not be placed on the ticket. Rather, the outcomes may be stored in an online database. To this end, a code may be stored on the ticket, the code being used as a decryption key used to find the outcome stored in the database. In particular, there may be a mapping between an outcome code and a corresponding decryption key that is printed on the ticket.

Because the decryption key is placed on the ticket, unauthorized access to the online game is not permitted without the physical ticket. In another embodiment, a portion of the decryption key is placed on the ticket, and another portion is stored in a database associated with the online game. In this manner, security cannot be breached without having both portions of the key (either having the issued ticket portion or the online portion). Thus, a hacker may not compromise a lottery ticket database without the ticket, and, by virtue of having a winning ticket, other winning ticket numbers may not be determined. Access to the online portion of the key may be obtained, for example, by providing some other information (e.g., a serial number printed on the ticket). However, it should be appreciated that the information used to gain access to the online portion of the key need not be printed on the ticket—the information may be provided on some other medium or by another method.

The ticket may be, for example, a scratch-type lottery or "instant" ticket, pull-tab, or type of pre-printed ticket type. Alternatively, the ticket may be a printed lottery ticket as is known in the art, which is a ticket printed at a Point of Sale (POS), usually in the form of a lottery drawing ticket (e.g., PowerBall or other type lottery drawing game). Also, the ticket may be an electronic ticket issued by a computer system. It should be appreciated that the ticket may be any type of ticket issued in any form, and the invention is not limited to any particular ticket type method of issuing a ticket.

According to one aspect of the present invention, a method for playing a game of chance is provided. The method comprises acts of issuing a ticket associated with the game of to chance to a player, where the ticket includes a code printed on a surface of the ticket, and providing for the player to play another game on a different medium than the issued ticket. According to one embodiment, conducting the another game comprises acts of; providing a plurality of elements arranged in a grid; associating, with at least one of the elements, at least one result; providing for a selection, by the player, to exchange at least two elements adjacent to each other among the plurality of elements; removing three or more similar elements arranged linearly within the grid; and revealing the at least one result associated with the play of another game. According to a version of this embodiment, the at least one of the three or more similar elements each share a common characteristic. According to another version of this embodiment, the method further comprises an act of revealing results of the game of chance to the player, wherein the code is used to gain security access to the results of the game of chance, and wherein the code is used to gain security access to play the another game. According to another version of this embodiment, the method comprises an act of revealing the at least one result to the player when the at least one of the elements associated with the at least one result is removed. According to another version of this embodiment, the three or more similar elements are matching elements.

According to another embodiment of the invention, the another game is a computer-based game and the different medium is a computer. In a version of this embodiment, the at least one result is at least a partial result of the game of chance. In another version of this embodiment, the at least one of the elements associated with the at least one result includes indicia indicating that the element is associated with the at least partial result of the game of chance. In another version of this embodiment, the method further comprises an act of revealing the at least partial result of the game of chance when the at least one of the elements associated with the at least one result is removed from the grid. In another version of this embodiment, the at least one of the elements associated with the at least one result is included in the three or more similar elements. In another embodiment, the at least partial result is a total amount of prize money associated with a game instance of the another game.

According to another embodiment of the invention, the method further comprises an act of revealing to the player an item associated with a second level game. In a version of this embodiment, the item associated with the second level game is used by the player to play the second level game wherein the item is used to reveal a prize won by the player. In another version of this embodiment, the item associated with the second level game is a spin provided in the another game, and wherein the method further comprises acts of permitting the player, in the second level game, to spin a slot machine game, the slot machine game having an associated pay table, determining and displaying an outcome of the slot machine game, and awarding a prize to the player if the slot machine outcome matches at least one entry of the associated pay table.

According to yet another embodiment of the invention, the method further comprises an act of providing the player with an additional opportunity to reveal results of the game of chance outside of the another game. In a version of this embodiment, the act of providing the player with the additional opportunity comprises an act of providing a separate game in which the player reveals the results of the game of chance. In another version of this embodiment, an act of providing a separate game comprises an act of providing a number matching game, wherein the method further comprises acts of associating one or more numbers with the player, associating one or more numbers with a win opportunity, and determining whether the one or more numbers associated with the player match the one or more numbers associated with the win opportunity.

BRIEF DESCRIPTION OF THE DRAWINGS

The accompanying drawings are not intended to be drawn to scale. In the drawings, each identical or nearly identical component that is illustrated in various figures is represented by a like reference numeral. Additionally, the left-most one or two digits of a reference numeral identifies the drawing in which the reference numeral first appears. For purposes of clarity, not every component may be labeled in every drawing. In the drawings.

DETAILED DESCRIPTION

Figure 2:
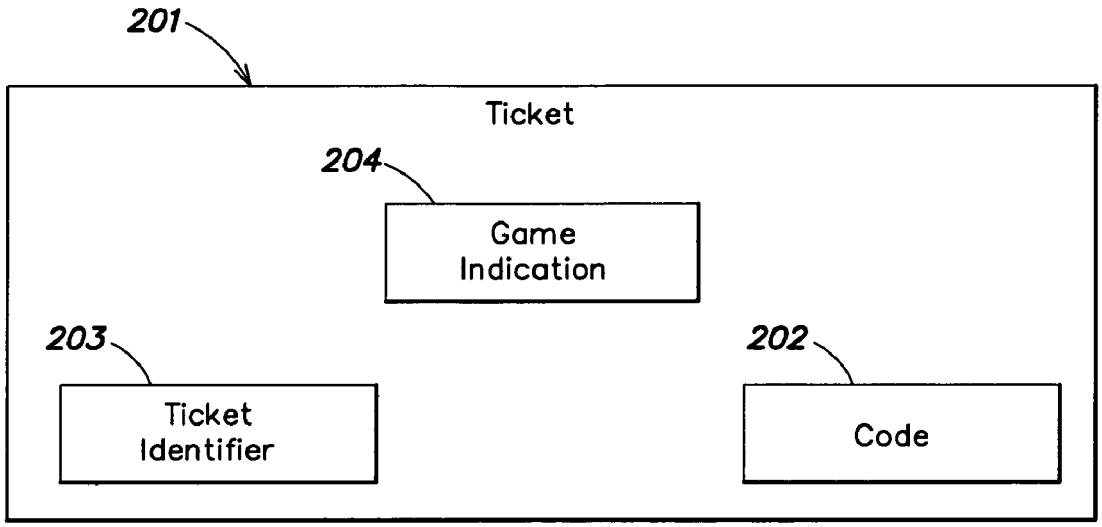
FIG. 2 is an example ticket that may be issued in association with a game according to one embodiment of the present invention.

Referring to FIG. 2, an example ticket 201 that may be issued to a player is illustrated. The player may scratch a surface of the ticket (in the case of a scratch ticket) to reveal one or more indications. These indications may include, for example, a serial number of the ticket, an access code, or other indication (or combination thereof) that may be used to access the online game. Alternatively, the ticket may be a pull-tab ticket or other ticket type suitable for presenting indications to a player.

The ticket may include other indications (e.g., a decryption key or portion thereof as described above that may be used to decrypt game results). Also, the ticket may indicate to a player the number of plays of a second game (e.g., as played by the player on a computer system). For example, in the case of a slot machine game, the ticket may indicate the number of spins that a player may be awarded by the ticket. In the case of a BEJEWELED-type game, the ticket may indicate the number of game instances (or plays) of the BEJEWELED-type game that can be played by the player. Further, as discussed above, the player may be permitted to play any one of a number of offered games, and the player may select different games to play to reveal results associated with game instances.

In one embodiment, ticket 201 includes a code 202 printed on a surface of the ticket that provides access to outcomes (e.g., prizes) stored on the server. As discussed, code 202 may also include, as an optional feature to increase security, a key that may be used to decrypt the outcome. This outcome may be stored in a database stored on a server system. Ticket 201 may also include a ticket identifier 203 used to identify the ticket, and which may be used to identify the outcome associated with the ticket. Further, ticket 201 may include a game indication 204 that relates information relevant to a game played on a computer system. For example, there may also be stored, on the ticket, an identifier that indicates, to the player, the number of plays associated with an online game. In one example, a player purchases a ticket at a retailer or other POS location.

Figure 1:
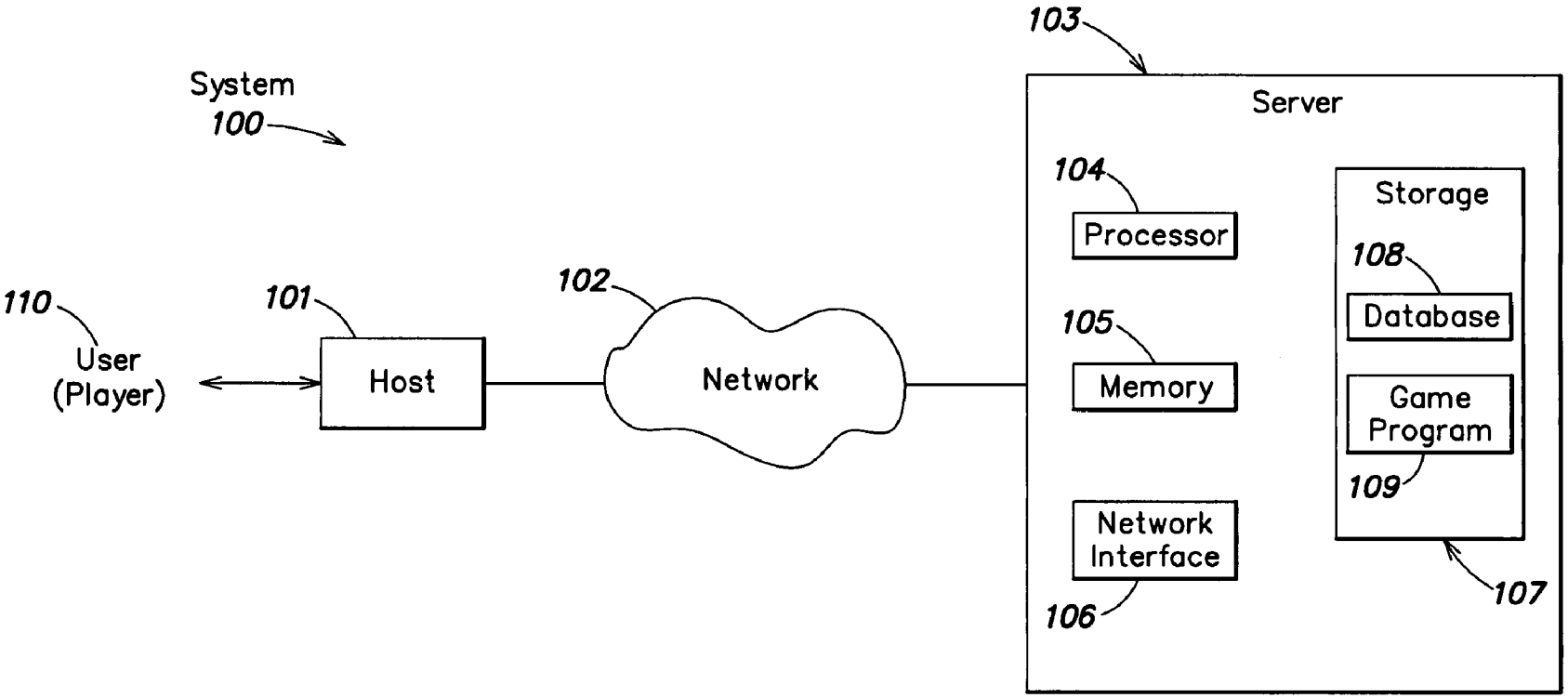
FIG. 1 is block diagram of a system for conducting a game according to one embodiment of the present invention.

After the player has purchased a ticket and thus received a code to access an online game, the player then proceeds to play the online game (the primary game) on a computer system. FIG. 1 shows an example system 100 according to one embodiment of the invention upon which a game may be played. The user (a player) 110 plays a game through an interface of a host computer system (e.g. host 101). Host 101 may be any type of computer system that is capable of playing a game. The host may be, for example, a general-purpose computer system (e.g., a personal computer (PC)) that connects to a network (e.g., the Internet). Other general purpose computer system types (e.g., a PDA, a cell phone, set-top box, or other system type) may be used to play the game.

The computer system may be coupled to a server system 103 through one or more communication networks 102. The server may provide a game program 109 that is executed by host 101 for playing the game. More particularly, game program 109, when executed, may provide an online game that can be played by a user through an interface associated with host 101. This online game may be, for example, a video slot machine, blackjack, or other online or casino-type game.

The game program may be stored, for example, in a computer-readable medium (e.g., a memory, storage, or other media) associated with server 103 that provides game programs. For example, the game program may be stored on a web server and downloaded to a client computer over the Internet. Game program 109 may be one of a number of game programs associated with an online game experience. Different game programs may be selectively downloaded to the client, based on the type of game ticket issued, the game selected for play by the user, the type of client used, or other criteria.

Server 103 may also be a general-purpose computer system, or any other type of computer system capable of authenticating tickets, providing game programs, and performing other game-related functions. Further, it should be appreciated that various game functions may be performed by one or more server systems. Server 103 generally includes a processor 104 for executing server-based game functions. Server 103 may also include a memory 105 for storing data associated with game programs. Server 103 may also include one or more network interfaces 106 that couple server 103 to network 102, which permit server 103 to communicate with one or more hosts. Further, server 103 may include one or more storage entities 107, including disks or other media for storing data. In one embodiment, storage 107 is adapted to store one or more game programs 109 as discussed above. Server 103 may have any number or type of processor that executes an operating system and one or more application programs. In one embodiment, server 103 provides web server content to one or more clients for the purpose of accessing and playing the game.

Server 103 may also include a database 108 that is adapted to store one or more outcomes associated with a ticket or other gaming piece. As discussed, these ticket game outcomes may be indexed using an identifier of the ticket.

Figure 3:
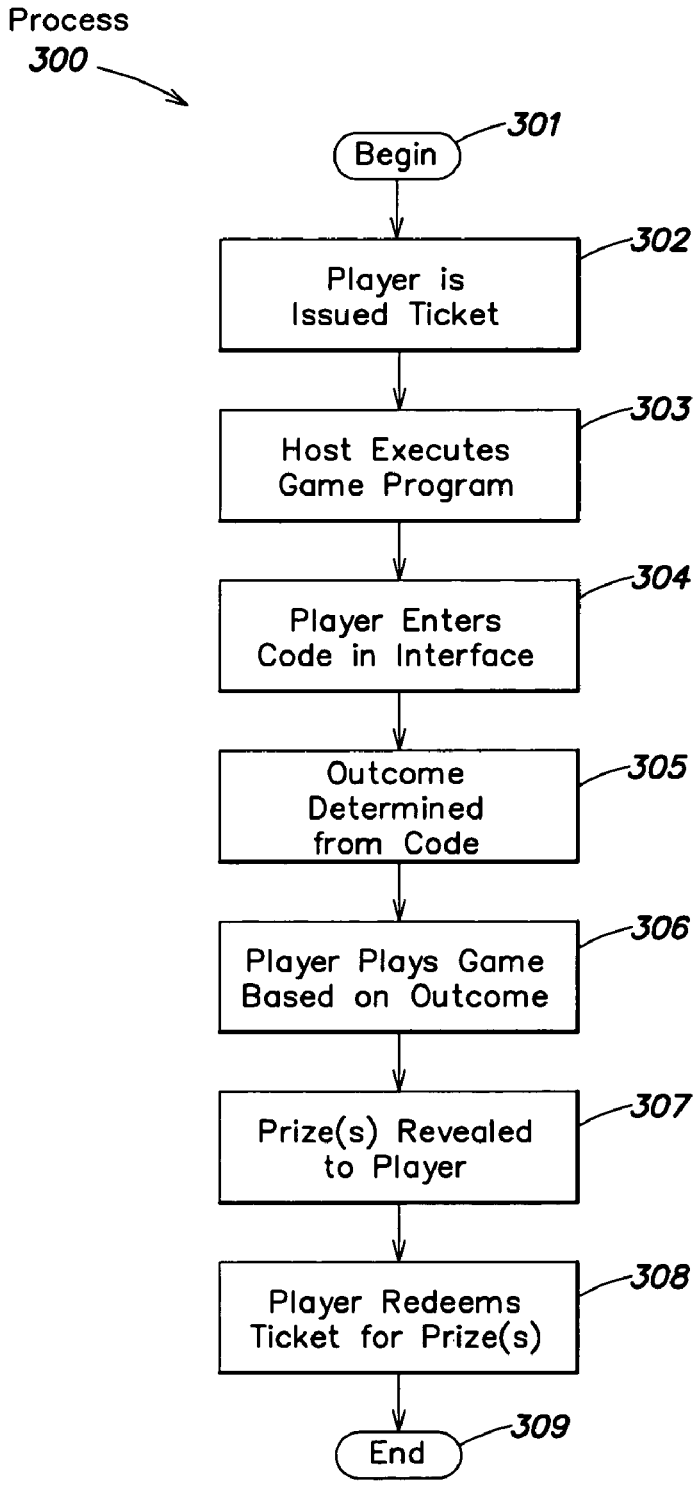
FIG. 3 is a flow chart of one example of a process for conducting a game according to one embodiment of the present invention.

FIG. 3 shows one example process for conducting a game according to one embodiment of the present invention. At block 301, process 300 begins. At block 302, a player is issued a ticket. As discussed, a player may purchase a ticket at a retailer or other POS location. At some later time and/or location, the player may play an online game on one or more computer systems (e.g., a PC or other computer system capable of playing games). For example, at block 303, a host computer system (e.g., host 101) executes a game program. The game program may be, for example, an online game that includes one or more components downloaded over a communication network (e.g., the Internet).

In one example, the ticket may include a code which is used to access the outcome of the game associated with the ticket (the ticket or secondary game). This code may be printed on a face of the ticket as discussed above with reference to FIGS. 2 and 7. In one example system, the player accesses a website that includes an interface in which the player may enter the code at block 304.

This interface may be, for example, used to access the game, or may be any other interface (e.g., an interface used to access a download website used for downloading game software (e.g., game program 109)). The interface may be programmed in one or more computer languages (e.g., an HTML, Java, Macromedia Flash, or other type interface) and may include a text entry box in which the player can input the code. The interface may include other ways of entering a code or other parameter (e.g., a glyph printed on a ticket) that allows the user to gain access to the game. It should be appreciated that the invention is not limited to any particular method for entering the code, or any format of the code, and that any type of code or method of entry may be used.

In one embodiment, the computer system may include a code generator that generates the access codes to be printed on the ticket. The access codes may be generated using, for example, a random number generator. The access codes may be collected and provided from the computer system to a game operator that produces the tickets. It is to be appreciated that the access codes may be provided to the game operator in any format required by the game operator such that the game operator may, for example using another computer system, print an access code on each ticket. In one embodiment, the code generator may produce more access codes than the number of tickets to be printed. For example, the code generator may produce 50% more access codes than a given ticket printing run is expected to need. This may be advantageous because it provides extra codes which may be used when errors occur in the ticket printing process. For example, an access code may be printed on a ticket that is then destroyed during a cutting or further printing operation. If the code generator has produced extra codes, another ticket may simply be generated to replace the destroyed ticket without the game operator needing to request an additional access code from the computer system. In addition, the game operator may shuffle the access codes provided by the computer system and randomly select the access codes to be used, thereby preventing anyone who accesses the code generator from determining which codes have been assigned to tickets. This may make the games more secure. In one example, the access codes may be transferred to and from the code generator (to and from the game operator) using a secure transfer protocol such as the well-known SCP program.

According to one embodiment, the player enters the code, and an outcome of the secondary game is determined at block 305 based on the code. More particularly, there may be a mapping between the code printed on the ticket and an outcome of the secondary game that is stored on the server. This code may be stored, for example, in a database structure stored in database 108 of the server. Database 108 may be, for example, a relational database, object database, flat file database, or other organizational entities used to store and maintain data. Further a listing of winning codes may be furnished to an organization that provides the ticket game (such as, for example, a state-run lottery commission). The code may, as discussed above, include an optional decryption key that decrypts an entry stored on the server. This entry may indicate one or more outcomes of ticket game instances.

In one embodiment, the outcome of the ticket game then may be used by the online game to determine play of the online game by the player at block 306. For example, if the stored ticket game outcome is "Win $50," the online game may present an outcome to the to player that indicates that the player won a $50 prize. This presentation may be in the form of one or more reveals presented to the player while playing the online game at block 307. The presentation may be progressive, in that the ultimate outcome (e.g., "Win $50") is achieved through a set of reveals or progressions through the online game. For example, in the case where a BEJEWELED-type game is played wherein items are collected for playing in a second level game, such reveal outcomes of each instance of the BEJEWELED-type game may be stored on the server. In another example, where elements of a BEJEWELED-type game are associated with intermediate results, those results (or outcomes) may be stored on the server.

As discussed, prizes may be distributed over game instances and/or items (or more generally, win opportunities) to maximize game interest and to entice the player to play each game instance associated with a particular ticket. For example, one approach may include providing to the player an early (relative in the series of game instances) indication of winning to keep the player interested. As the player plays more game instances, the magnitude of the prizes may be adjusted such that a level of game "drama" is increased. That is, prize values are adjusted among later game instances to provide relatively higher prize values in later games. Other approaches/distributions may be provided for increasing or maintaining game interest.

Once played, the player may redeem the ticket at the point of sale or other redemption location at block 308. Alternatively, the player may be permitted to redeem the ticket without playing the game. Redemption may be permitted, for example, after a predetermined time. For instance, the player may be permitted to redeem a ticket after a set time (e.g., 10 PM), a particular time period after ticket purchase (e.g., 24 hours) or other absolute or relative time. This may be the case for a Keno or lottery-based system, where a Keno or lottery result is made available at a set time after ticket purchase. Alternatively, tickets may be redeemed immediately after purchase. At block 309, process 300 ends.

Payouts may be determined by a pay table associated with the game. The number of tickets may be determined a priori, and a pay table that determines payouts may be allocated to the tickets. This allocation may be determined, for example, by shuffling the pay table and allocating results to tickets. The following is an example of a pay table that may be used with a game according to one embodiment of the invention:

Number of Tickets Issued: 2000

Ticket Price: $5

TABLE I

Example Payout Table

| Number of Tickets | Payout |
|---|---|
| 1 | $100 |
| 700 | $10 |
| 500 | $5 |
| 100 | $1 |
| 600 | $0 |

Game Operator Return: $300 (3%) - expenses

As shown in the example above, a certain number of tickets may be allocated as winning tickets having a particular payout (e.g., an outcome). Some tickets may have no payout associated with them, and some may only have a nominal payout (e.g., a small award amount, free ticket, etc.). A small number of tickets may include a large payout as compared to the magnitude of other payouts. It should be appreciated, however, that payouts are not limited to money, but other types of prizes may be awarded including merchandise, credit, loyalty points or any other representation of value.

The odds of winning may be the type of odds experienced in actual (rather than computer-based) games. Alternatively, the odds of winning may not necessarily be "natural" odds of winning any particular type of game, but rather, the odds may be adjusted to obtain the outcome desired (e.g., by the gaming operator). The odds of winning, number of winning tickets, amount of payout per ticket, or other payout parameter may be any amount or number, and the invention is not limited to any particular odds of winning, number of winning tickets, payout amount or type of payout. However, according to one embodiment, the overall odds of winning, amount and type of payout, etc. may be similar to a game previously approved by regulators (e.g., scratch ticket games, Keno, Bingo, etc.) so that the use of an additional game to display an outcome associated with the previously-approved game is scrutinized much less by regulators, and as a result, the approval of the additional game is less burdensome. To this end, a system associated with the previously-approved game may provide ticket and outcome information to a system conducting an online game (e.g. server 103).

As discussed above, the code stored on the server (e.g., server 103) may be used to determine game play as played on the computer system. For example, the game outcome may to be "Win $50." In the case of a slot machine-type game, the ticket may indicate that the player receives 10 spins of the slot machine. The outcome of each spin may be predetermined, and the game may retrieve information from the server indicating a predetermined sequence of game play as discussed above. In the case of a slot machine-type game, the predetermined sequence may indicate the winnings associated with each of the spins. In the case of a BEJEWELED-type game, the outcome of each instance of the second level game may be stored on the server and retrieved prior to game play.

In another example, only the overall outcome is predetermined (e.g., the total winning associated with the ticket), and the sequence of game play may be determined when the game is played. In the example above where the player is indicated as winning $50 over 10 spins, the $50 winnings (and any intermediate losses) may be allocated to the player at any point over the 10 spins. In the case of the BEJEWELED-type game, winnings may be allocated across game instances. In a further example, winnings may be allocated across items collected while playing the BEJEWELED-type game. Because the number of items (e.g., spins) collected may vary depending on the skill of the player, the distribution of prizes among collected items may be determined during game play by the game playing system. Thus, according to one embodiment, the player's skill (or lack thereof) does not affect the overall outcome of the game.

This allocation may be determined by the server, the game software executing on the client, or a combination thereof. Further, the game play may be randomized in that a further play using the same ticket may yield a different sequence of game states leading to the same outcome. For example, in the case of a slot machine game as described above, a player may be indicated as winning $50, but the sequence by which the player attains the $50 winning outcome may be different depending on various factors. Such factors may include a randomization function that determines results of individual game plays (e.g., in the case of a series of "spins," the result of each spin), or some other function. The series of intermediate outcomes may be stored in a database associated with the server as discussed above with respect to game outcomes. Also, the outcomes may be adjusted using a formula or rule-based approach during execution of the game to increase the game drama and heighten the game playing experience.

According to another aspect of the present invention, a player may purchase a ticket at a point of purchase (e.g., a convenience store) and the indication of a win/no win condition of the ticket is revealed on a different medium. For example, a player purchases a scratch ticket in a convenience or other type of store. The prize that the player wins is not revealed on the scratch card itself, but rather the prize is revealed through another medium (e.g., on a home computer system, PDA, cell phone, etc.).

For example, as discussed above, the player may be presented another game (e.g., a slot machine or BEJEWELED-type game as described above) that reveals at least a portion of the prize. The underlying prizes available via the reveals may be predetermined, in that the outcome of the game may be stored in one or more systems. The scratch ticket may reveal different numbers of plays (e.g., pulls in the case of a slot-machine type game, or game instances of a BEJEWELED-type game) the player receives.

In one aspect of the present invention, the ticket includes authentication information that is used to obtain the reveals. In one example, the scratch ticket contains a secret key which is used to decrypt the results that are revealed to the player. That is, according to one aspect, it is impossible to determine if and what a particular ticket wins without having possession of the ticket (and therefore the secret key). In another example, the scratch ticket could contain only a portion of the secret key. The other portion of the key may be stored, for example, on a server and retrieved from a database (e.g., file, relational database, etc.) based on, for example, the serial number of the card. Mappings of serial numbers of tickets to encrypted results can be provided to the lottery provider for additional audit control.

Figure 4:
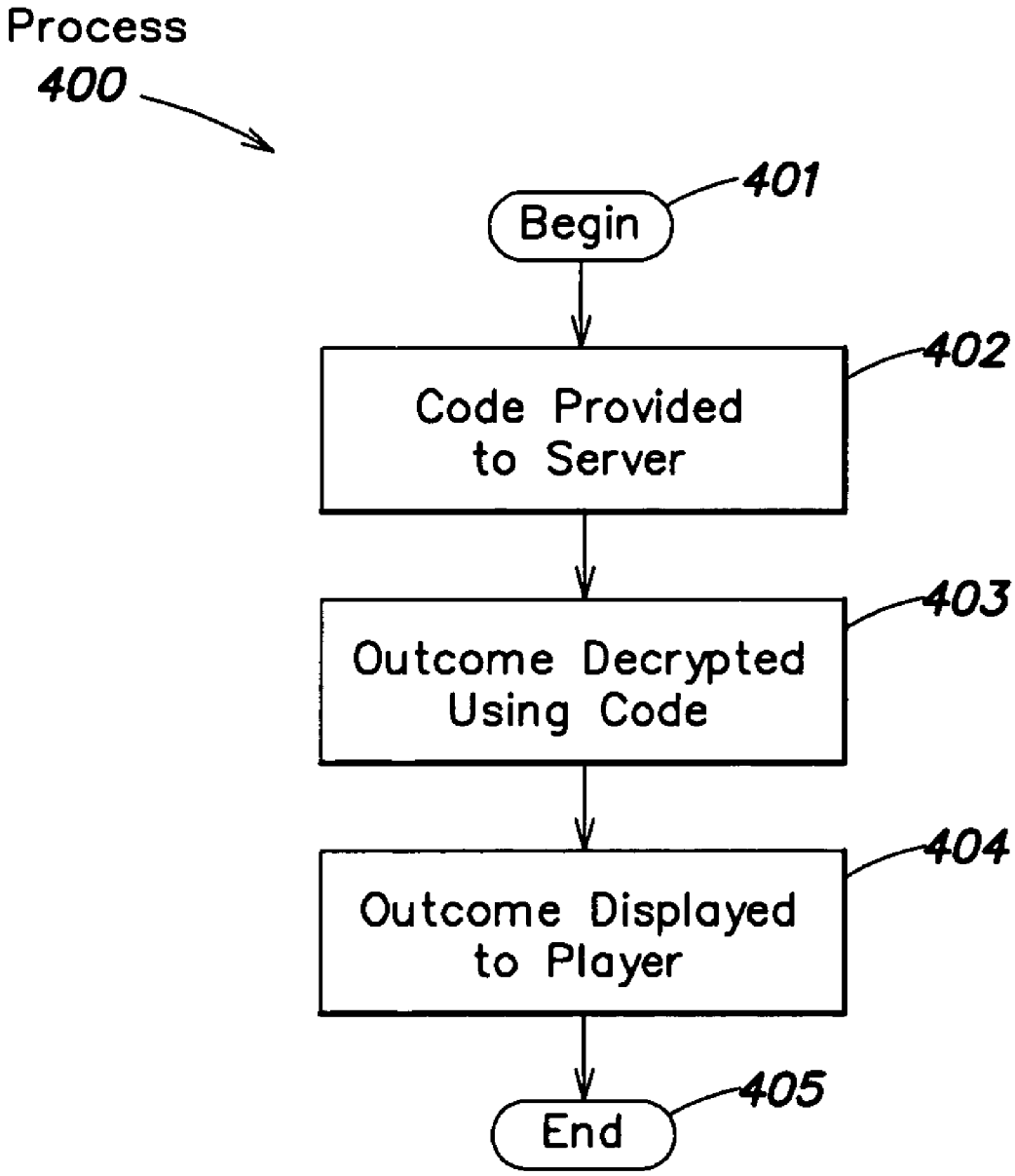
FIG. 4 is a flow chart of one example of a process for conducting a game according to another embodiment of the present invention.

A process for performing secure access to outcomes is shown in FIG. 4. At block 401, process 400 begins. A server (e.g., server 103) may store a number of outcomes in encrypted form, each of which outcomes can be accessed by a respective code. These outcomes may be encrypted, for example, using any encryption method (e.g., symmetric, asymmetric encryption) as is known in the art. At block 402, a code is provided to the server (e.g., server 103).

This code may be, for example, a secret code (e.g., a symmetric key, a private key) printed on a ticket and provided to the server by a user through an interface of a computer system as discussed above. The received code may be transmitted between systems using a secure transmission method (e.g., SSL) as is known in the art. The received code is used at block 403 to decrypt the outcome stored on the server. This code may be any decryption key type that may be used to decode data, and may be of any format or length. The decrypted outcome may then be presented to a player at block 405. The outcome may be displayed using any method. For example, as discussed above, the outcome may be presented through one or more reveals presented to the player during play of an online game. At block 405, process 400 ends.

Another aspect of the present invention relates to a lottery-based software game that can be played over a network, such as the Internet. According to one embodiment, the system includes a purchase of a scratch-based or printed ticket by a player at a point of service (POS). A POS may be, for example, a place at which lottery tickets may be sold, including convenience stores or other locations where lottery products are provided. In an alternative system provided at a casino or other gaming establishment, a ticket may be sold to a player at the casino for play at a later time.

The player receives the ticket at the POS or other location, and proceeds to play a computer-based game at another location to reveal a result (or outcome) of the game. The computer-based game may be, for example, a casino-type game (e.g. slot machine, video poker) or other type of game, including amusement games or games of chance. In the case of the scratch or printed ticket, the result is not apparent to the player until the player plays the computer-based game. This game may be, for example, a software program that is downloaded and played over the Internet. Alternatively, other ways of accessing the online portion of the game may be used (e.g., PDA, cell phone or other method).

The ticket includes a code by which a player gains access to a result stored on a server that stores ticket information and results associated with each ticket. Such information may be predetermined at the time of ticket sale, or the results may not be known until a later time, after the ticket is issued to the player (e.g., in the case of a Keno, bingo, or other drawing-based system). According to one embodiment, the code is an access key (or a portion thereof) that is used to access the result stored on the server. Further, the result (stored in the server) may be encrypted. For example, the code may be a private key or a symmetric key. The key may be transmitted by a client computer system to the server for the purpose of decrypting the result using SSL or any other secure method.

Because the decryption key is stored on the ticket, the gaming system is safer, as a breach of security of either the tickets or the server does not provide access to result information. More particularly, access to the lottery ticket database may not be accomplished without the ticket (used to decrypt the result). Further, the tickets may not be correlated to results without the lottery ticket database (because the results are stored in the database, not on the tickets).

In another example of the system, a portion of the key used to decrypt results of the game is stored on the ticket, and another portion is stored in the database of the server. In this manner, it is assured that possession of either portion of the key may not compromise the results.

However, it should be appreciated that the system does not require SSL or any other encryption/decryption method, a decryption key on the ticket, or the stored result on the server to be encrypted. Rather, the game can be implemented with or without these features. That is, access to the outcome stored at the server may be performed using only the serial number or other ticket identifier printed on the ticket.

The scratch-based or printed ticket also includes a second serial number or other identifier (e.g., an access code) in addition to the serial number or other identifier which is correlated to results on the server. A ticket may include both a serial number and a ticket identifier used by the system. According to one embodiment, it is appreciated that there may be security issues with using the serial number of a printed ticket (as printed on the ticket) to correlate to win outcomes. That is, the lottery provider may not allow any entity outside of the lottery system to have the ability to correlate outcomes to serial numbers. To this end, another identifier (e.g., a separate ticket identifier or access code) may be provided on a ticket to allow the system to index into an outcome database.

In one example system that works in association with a lottery system, outcomes for a game may be predetermined to comply with lottery rules. In this case, outcomes are predetermined and stored in a database. In an alternative environment where results are not permitted to be predetermined (e.g., in a casino), but rather are determined at a later time (e.g., by a drawing or other method), a ticket issued by a system in such an environment may have an associated drawing time when a game may be played. In the case where the online game system is driven by a Keno game result, each ticket may be associated with a set of numbers in the Keno game, and the result of the Keno game is provided as the result for the online game. In one example, a computer system automatically picks numbers associated with the ticket at the point when the ticket is issued. Thereafter, when the Keno game occurs, the result of the Keno draw is provided to an online game system, which translates the Keno result to a game experience within another game (e.g., BEJEWELED, COLLAPSE, slot machine, etc.). It should be appreciated, however, that although the game of Keno may be used to drive an online game experience, other games (e.g., Bingo) may be used.

The server (e.g., server 103) may be capable of accepting, from the user, an input of the serial number and decryption key, and in response, providing the results associated with the particular ticket. The result or outcome of the game may be displayed to the player in an interface of the computer system (e.g., a client computer system such as a personal computer (PC)) used to play the computer-based game. For example, the outcome of a series of plays associated with the ticket may be stored in the server, and provided to the client, and the series of outcomes may be presented to the player during play of the computer-based game.

In another embodiment of the system, a payout of the ticket may be encoded on the ticket. For example, if the ticket is a $5 winner, the amount of the win may be encoded on the ticket. In the case of the casino-based version of the system, the payout may not be stored on the ticket (as the payout is not predetermined), but rather the purchase price of the ticket may be stored on the ticket, or some other identifier of the ticket.

Figure 5:
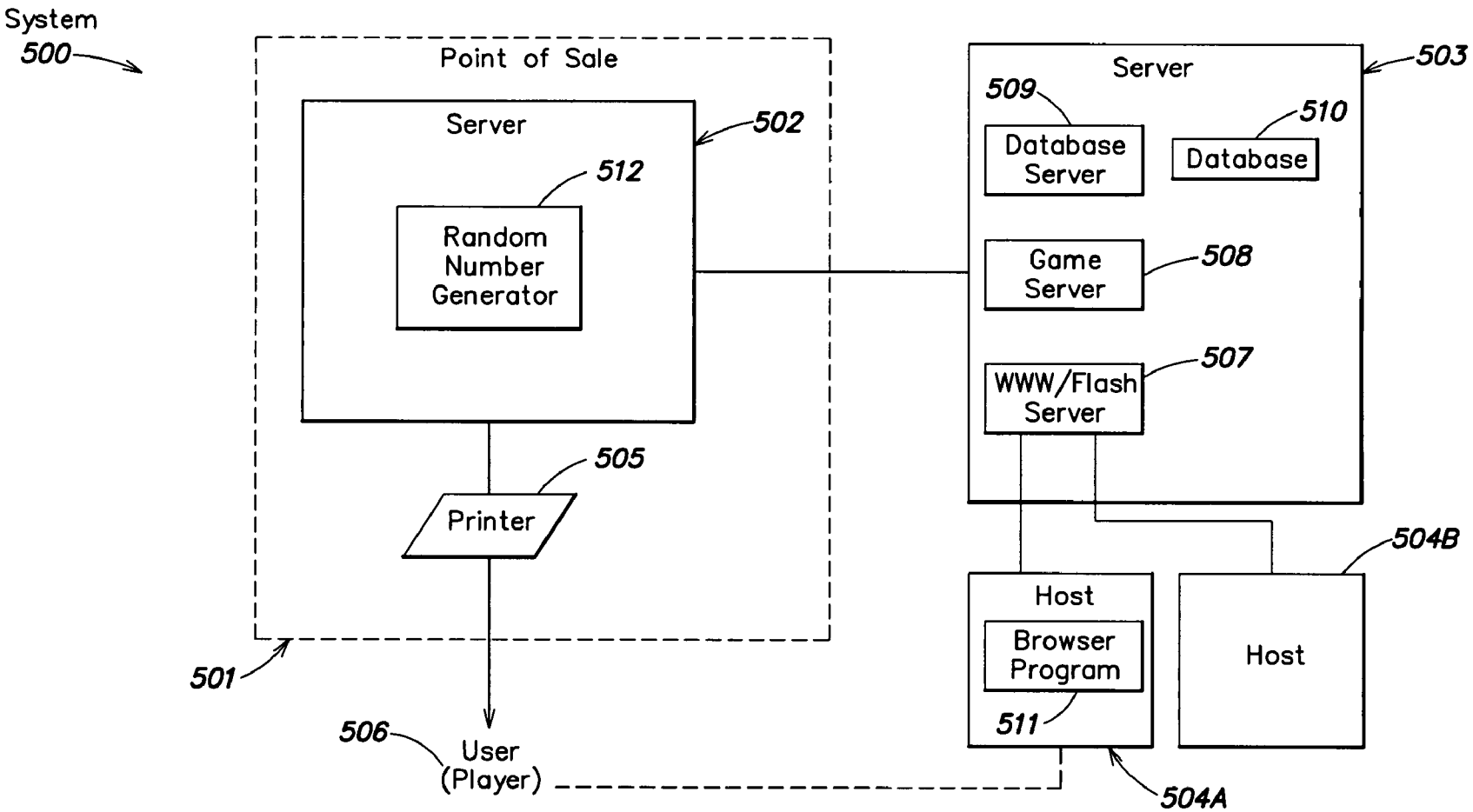
FIG. 5 is a block diagram of one example of a system for conducting a game according to one embodiment of the present invention.

As shown in FIG. 5, a system 500 may be provided having more than one server. For example, a server 502 provided at the point of sale 501 is primarily responsible with issuing tickets to a user/player 506. To this end, server 502 may issue preprinted tickets or may issue tickets printed from an associated printer 505. Such tickets may include one or more identifiers as discussed above with reference to FIG. 2. As discussed, another system such as a Keno or lottery-based system may be used to provide results to an online game system.

In one version of system 500, the win/loss determination of a ticket may be driven by a later-occurring drawing. For example, a Keno-based, Bingo-based, or other type lottery draw system may be used wherein the outcome of a particular game is not known until a future time (e.g., when a drawing occurs). In this case, the ticket identifier stored on the ticket may be an access code generated from ticket identifiers in the Keno-based system (e.g., by an intermediate system or the Keno server itself that can translate a Keno ticket identifier into another type of identifier).

Generation of an identifier separate from the Keno ticket identifier may be necessary for security reasons relating to the Keno system. More particularly, access to the Keno ticket identifiers may not be permitted by the system (e.g., the Keno server). In one example, a Keno system translates Keno ticket identifiers into access codes and results that are stored on the game server (e.g., server 503). Thereafter, clients (e.g., hosts 504A, 504B) access results stored on the server based on their respective access codes.

As discussed above, one or more hosts 504A, 504B (e.g., general purpose computer systems) may communicate with a server 503 over a network for the purpose of conducting a game. In one example, a host 504A renders a browser window by executing a browser program (e.g., the Internet Explorer browser program available from the Microsoft Corporation). A user/player 506 enters a URL address specified by an issued ticket in a window of the browser interface, and is directed to a website associated with server 503. This website may be rendered by, for example, a WWW server process (e.g., server 507) associated with server 503.

Player 506 may be instructed to enter an access code (and/or any other required information) to access one or more games in an interface presented through the browser. As discussed, server 503 may validate the received access code, and provide any results stored in a database associated with server 510. Once validated by server 503, the user may be permitted to play one or more games. These games may be, for example, programmed using one or more programming languages (e.g., Macromedia Flash) and may be downloaded to host 504A and executed.

According to one aspect of the present invention, it may be beneficial to provide a game program that may be downloaded quickly to a client and played by a player without requiring any installation procedure, requiring operator (player) intervention, or delays in downloading large files. To this end, the game program may be programmed in a language supported by a majority of game playing systems (e.g., Macromedia Flash, etc.), and played without the need for downloading and installing large software components. In one specific example, the game program may execute within a browser program (e.g., the Microsoft Explorer browser program) window. In this manner, less-sophisticated players who have difficulty using computers and/or installing software may not be prohibited from playing the game. Of course, it should be appreciated that any programming method may be used that requires or does not require any installation procedure, and the invention is not limited to any particular programming method.

Also, outcomes associated with any games may be downloaded prior to game play. As discussed, examples of games include those that may be of the lottery-type (e.g., having a predetermined outcome) and those that are casino-based (e.g., having an outcome that is not determined at the time of sale of the ticket). In the case where a later drawing affects an outcome, a player may not be permitted to play the game until the drawing occurs (and until results are available at server 503). In the case of a drawing that affects outcomes, drawing results can be communicated from server 502 to server 503. In addition, server 502 may maintain a mapping from a ticket identifier (e.g., a serial number) to an access code provided on the ticket, and provide a mapping of outcome to access code when the drawing occurs. As discussed, such outcome information may be maintained in a database 510 associated with server 503 and may be accessed through a database server process 509.

As discussed, the payout of the lottery ticket may be displayed to a player in a number of ways. For example, the payout of the ticket may be presented to the player through one or more reveals presented to a player during one or more plays of an online game.

For example, in the case of a slot machine game, a player may be permitted, with the issue of a single scratch or printed ticket, a series of spins of the slot machine. The slot machine may, as the result of each of the spins, produce results that contribute to the overall payout to the player. For example, after a single spin, a player may be presented an indication that he/she has won $5. The payout to the player as provided from the server database may be, for the series of spins, $50 overall, with particular outcomes for each spin. Additional spin results may provide the additional $45 that the player will receive. Additional spins may add, subtract, or have no affect on the contribution to the outcome of the game. These results of each spin of the slot machine game may be stored in the database of the server indexed by the ticket identifier, or may be randomly determined by the game program that renders the game. Further, as discussed above, the results of each spin may be "scripted" such that the game experience is more exciting to the player.

For example, in the case where the results of each spin are stored on the server, the series of results may be downloaded to the client at the beginning of the game as a series of entries, and the client may reveal each result as the player progresses through the series of spins. In the random method, results for each individual spin are not predetermined, but rather are determined by the client in a random manner. For example, the actual outcomes of each spin may be randomly chosen among the possible combination of outcomes that may produce the required payout. In either case, the outcomes for each spin of the slot machine game is not stored on the ticket, but rather is stored at the server and downloaded just prior or during game play, or is determined randomly by the client. Alternatively, the client may determine the game experience based on a predetermined set of rules or formulas that, when an overall outcome is provided, allows the client to determine intermediate outcomes in a dynamic way.

Because the game play and outcome are scripted, a player may also not play the game (and possible secondary games) to actually win. A player may purchase a ticket, wait until the ticket may be redeemed, and go to a POS to find out (and if necessary, receive) his/her winnings. A ticket may be allowed to be redeemed after a predetermined period of time after the drawing independent of whether the player has played the game. A ticket may be able to be redeemed after a predetermined period of time, from almost immediately to seconds to days or any predetermined time. For tickets with results dependent upon results of a particular Keno game or other event, the ticket may not be redeemed until after the event has passed.

Finally, after play of the online game, the player is permitted to validate the ticket at any POS location (e.g., 501 (for example, a lottery agent, casino, or other gaming establishment) to redeem his/her winnings as indicated during the online portion of the game. According to one embodiment, players are permitted to redeem their winnings only after playing the online portion of the game. The player, by playing the online portion of the game, sets status information at the server (e.g., server 503). When the player attempts to redeem the ticket at the POS (e.g., 501), the status information may be checked, and the player is permitted to redeem his/her winnings. To this end, server 503 may communicate information back to server 502 relating to game play.

For example, server 503 may collect information that indicates the sequence of game play performed at the client, and other player tracking information. In one example, tickets may be associated with a particular player, and the player may be awarded loyalty points or other credit for playing the game.

Taking a BEJEWELED-type game, a player is issued a ticket at a POS to play one or more instances of the BEJEWELED-type game. The ticket indicates an access code, and the player uses this access code to gain access to the system (e.g., from a host coupled to server 503 through the Internet). The player enters the access code in a user interface, and, once validated, is permitted to play the BEJEWELED-type game. As discussed, the BEJEWELED-type game is a version of the well-known game of BEJEWELED, which is a game of skill-based puzzle game. Optionally, the player is permitted to play, based on a single access code (and ticket), any one of a number of games available from server 503. Such an option may allow a player to play different games for each game instance associated with the ticket.

Figure 6:
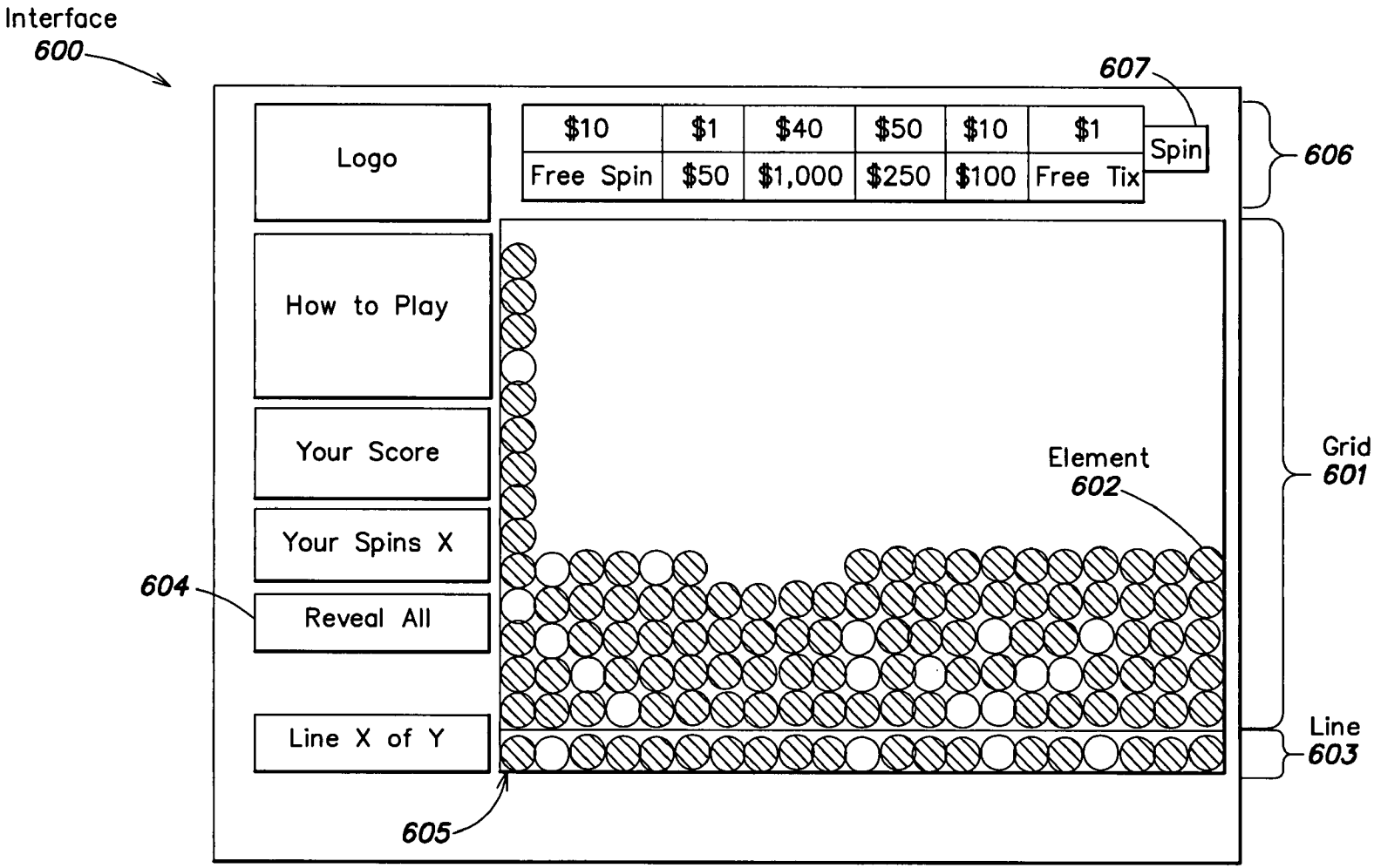
FIG. 6 is an example of a game interface according to one embodiment of the present invention.

FIG. 6 shows an example game interface 600 according to one embodiment of the present invention. In this example, a COLLAPSE-type game is shown. The COLLAPSE-type game involves an interface 600 that has a grid 601 of elements (e.g., element 602). Similar elements within grid 601 may be identified by color, shape, or any other indication. One or more new lines of elements (e.g., line 603) are fed into the bottom of the grid periodically.

A player removes groups of similar elements by selecting them within the grid, and the player is awarded points based on the number of elements removed. For example, similar elements may be indicated by color, and groups of similarly-colored elements may be removed from the grid. In one example, groups of three elements can be removed. Removal of larger groups of similarly-indicated elements may provide more points than smaller groups. It should be appreciated, however, that elements may have one or more indications that represent that they are similar, and the invention is not limited to any particular indication(s). Further, it should be appreciated that any number of elements may be removed as part of a group, and the invention is not restricted to any minimum number of element that may be removed.

Lines are moved into a preview area 605 associated with interface 600 that permits the player to anticipate what element types are being placed into grid 601. Lines of elements may be moved into the grid at a predetermined rate, and the rate may be adjusted from time to time during game play. In one example, elements may be fed into the preview area from left to right, and when a line of elements is complete, the line of elements is pushed into grid 601. The COLLAPSE-type game ends when the grid overflows with elements or a final line (e.g., of a predetermined number of lines) is fed into grid 601. As an additional option, a player may bypass play of the COLLAPSE-type game by selecting a "Reveal All" element 604 within interface 600. Selection of element 604 may cause the COLLAPSE-type game to end and may allow the player to progress to a second level game.

As discussed above, the second level of the game may be played with items collected during the COLLAPSE-type game. Also, as discussed, these items may be hidden within elements of the grid (e.g., grid 601) and released as elements are removed. In one version of the game, items such as spins of a wheel or sticks of dynamite (a.k.a. "hotsticks") are located within elements in the grid. Items (spins, sticks, etc.) are accumulated and used in the second reveal-type game to reveal a payout or other type of prize. As shown in interface 600, there may be a prize window 606 in which prizes are awarded.

Window 606 may indicate a number of available prizes, and may include an interface control (e.g., spin control 607) that allows the player to initiate the second level of the game. Window 606 may be a part of or separate from a window that includes grid 601. After the to player selects control 607, window 606 indicates what, if any, prize is won. Interface 600 may also include an indication of the number of spins or other items remaining to be played by the player in the second level game.

In the example game discussed above having one or more elements containing hidden items (e.g., safes), sticks of dynamite or other items collected may be used to uncover the hidden prizes in the second level portion of the game. For instance, winnings (e.g., cash prizes) revealed within opened safe elements are awarded to the player. In one example, the reveal of the number of sticks awarded to a player may be randomized by the client computer, with at least one stick awarded to the player to allow the player to open at least one safe.

After play of the second level game, game play is returned to another instance of the first level game (e.g., the COLLAPSE-type game). The player may, however, choose to play a different game (e.g., a card game or other game) at the conclusion of any particular game instance. The player may be permitted to play further instances of the COLLAPSE-type game, with each level of the Collapse-type game leading to a second level wherein prizes are revealed. These intermediate prize amounts that are revealed with each instance of the COLLAPSE-type game, as discussed above, may be stored in a database of the server, and provided to the client prior to or during game play. Alternatively, intermediate prize amounts may be determined at the client in a random manner (e.g., by randomly selecting a possible combination of intermediate prize amounts that total the overall prize awarded to the player). In another example, a game may be determined dynamically by the game system or client based on one or more rules. These rules may be tailored so that the overall result is revealed by the game system in an interesting way.

For instance, the ticket may have an overall prize value of $50, and the prize awarded at each instance of the COLLAPSE-type game may accumulate to form the $50 prize. There may be a finite number of combinations based on the number of game instances to achieve a $50 prize, and the actual game experience presented to the player may be a random selection of the finite outcomes. In any case, the result of each game instance is either stored at the server or is determined randomly or dynamically by the client as discussed above.

According to one embodiment of the present invention, a COLLAPSE-type game is conducted that may include the following additional aspects, either alone or in combination:

- The game begins with a fixed number of lines of colored elements already positioned on the game grid (e.g., grid 601) and available to be selected by the user (or player).
- New elements fill the bottom and/or the top of the screen, from left to right, one at a time, but are not available to be selected. When a row is complete, the line of elements is pushed onto the game grid and added to those elements in active play. Alternatively, new elements may fill the game grid from any edge, including from the right and/or left side.
- Selecting the preview area as lines are being formed causes the preview area to fill with elements and the elements to be added to the active play area.
- The user can clear elements from the active area by selecting any three or more same-colored elements that are touching.
- When a user positions a selection device (e.g., a mouse pointer) over a group of elements that are eligible to be cleared, the group of elements changes in appearance.
- When elements are cleared, the elements above fall downward and toward the center to fill any void created by removed elements.
- When the user clears an element that contains a dynamite stick (or other item) in it, that stick is placed to the right of the game board for use in the second level game (e.g., a prize round).
- When the stack of elements comes within a predetermined number (e.g., three) of rows of the top of the game area, a warning area flashes.
- If the elements reach the top of the game area, the COLLAPSE-type game ends and the user is taken to the second level game.
- If the user collects a predetermined number (e.g., six) of dynamite sticks, the COLLAPSE-type game ends, and the user is taken to the second level game.
- The user begins the game with one dynamite stick collected for him/her.
- At the second level game, the user is presented with a grid, 6 by 6, of safes.
- The user selects a button and the first dynamite stick is used.
- The stick begins at the top left most safe and moves over each safe in turn, from left to right, top to bottom, one at a time.
- The safe that the stick stops at is blown open to reveal either a cash amount or other prize type or an indication that no prize is awarded.
- If multiple sticks are available for use, each subsequent stick starts at the safe immediately after the safe that was blown open.
- The sticks skip over safes that have already been opened.
- At the conclusion of the game, the user is presented an indication that the second level game is over and an indication of any prize(s) awarded.

BEJEWELED-type games provide further examples of games that can include a grid of elements. Games similar to BEJEWELED include, for example, JEWEL QUEST and JEWEL DROPS (JEWEL QUEST is a registered trademark of iWin, Inc. of San Francisco, Calif.). Other similar games may be used.

Figure 7:
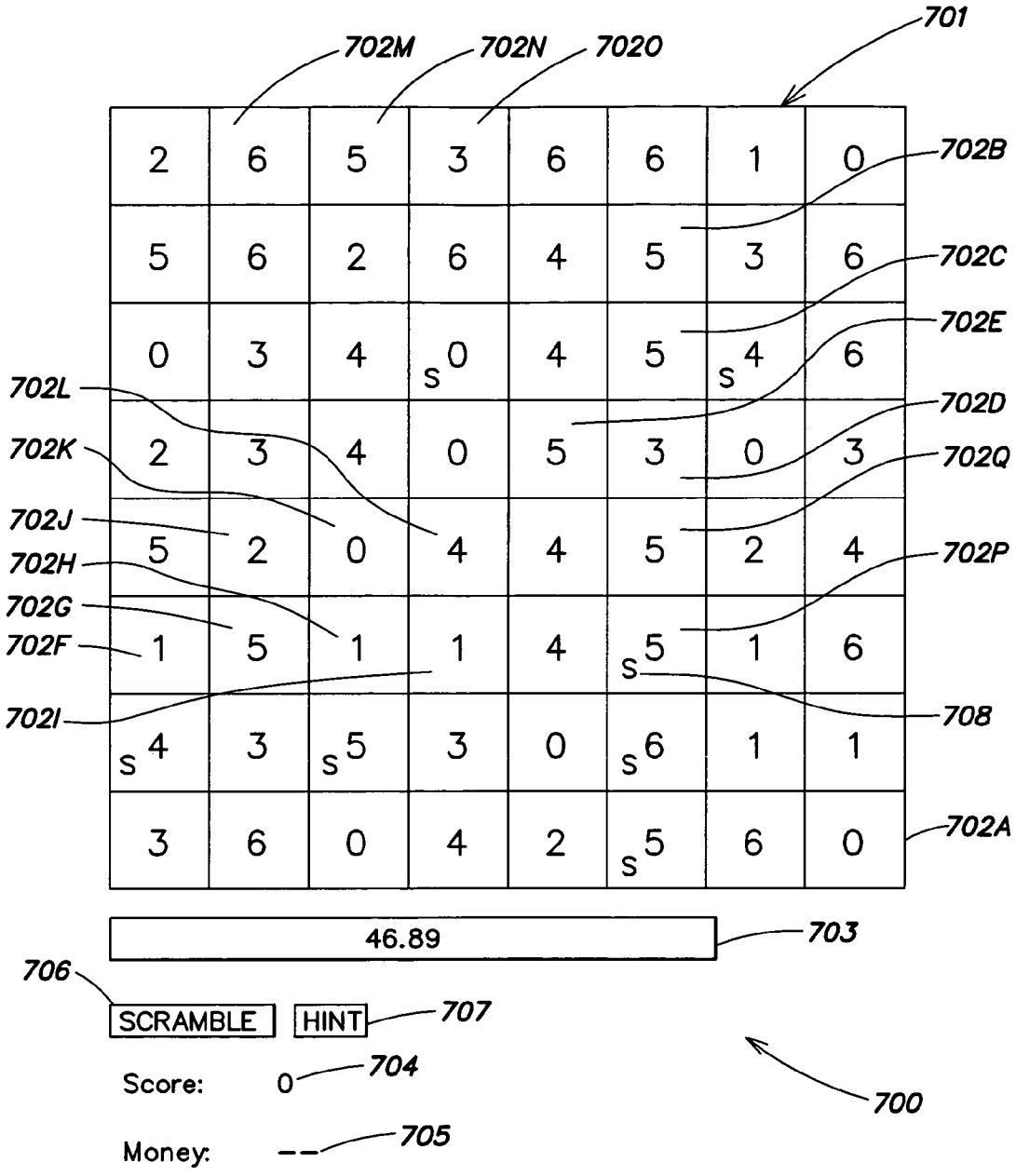
FIG. 7 is another example of a game interface according to another embodiment of the present invention.

FIG. 7 shows an example game interface 700 according to one embodiment of the present invention employing a BEJEWELED-type game. The BEJEWELED-type game involves an interface 700 that has a grid 701 of elements (e.g., element 702A). Elements within grid 701 may be identified by color, shape, or any other indication. According to one embodiment, similar elements share one or more common characteristic, for example, they may share one or more of a shape, a color, an indicia and any other characteristic. Matching elements are similar elements included in a family of elements that share the one or more characteristic that is common to family members but that is not found in some of the other elements located within the grid. For example, elements 702B, 702C each possess a common numerical identifier (e.g., 5). The grid may include a plurality of families of matching elements where each family shares one or more characteristics common to them that are not found in elements in the other families of elements. For example, each of the elements (e.g., 702B, 702C) associated with the same numerical identifier may also be the same color as one another while elements associated with a different numerical identifier (e.g., 1) are a different color. According to one embodiment, the elements are graphical representations of gem stones where each family of elements shares separate characteristics concerning a color and a shape that are distinctive to that particular family of elements. As stated above, however, any characteristic or combination of characteristics can be used to distinguish the elements in a first family of elements from the elements in a second family of elements provided that the characteristic can be identified by players who play the game.

In general, a player plays the BEJEWELED-type game by moving elements within the grid to create a group of matching elements that appear in consecutive locations in the grid 701. In one embodiment, once three or more matching elements (e.g., they are part of the same family of elements) are located in consecutive positions within the grid 701 they are removed from the grid 701. In a version of this embodiment, the consecutive locations are linear and occur either vertically (e.g., in the same column) or horizontally (e.g., in the same row). That is, matching elements located diagonally in consecutive locations in the grid are not removed in this version. In another version, however, matching elements located diagonally in consecutive locations in the grid are removed. The groups of matching elements that qualify for removal from the grid 701 are considered an adjacent group because each element in the group is adjacent at least one other matching element in the group.

As mentioned above, in one embodiment, an adjacent group of matching elements may be removed when three or more of the elements appear in consecutive locations in a row or column. In this embodiment, the end locations in the group (i.e., the top and bottom locations among a vertical group and the leftmost and rightmost locations among a horizontal group) are adjacent one position in the grid 701 where another member of the group is found. More specifically, within the group a first position is adjacent a second position, the second position is adjacent both the first position and a third position. In a group of three elements, the third position is only adjacent the second position in the group. Larger groups of adjacent matching elements may be formed, however, in which the third position is adjacent to both a fourth position and the second position. In addition, in other embodiments, to provide variety and/or increase the degree of difficult of the BEJEWELED-type game, other configurations of adjacent groups of matching elements may qualify for removal from the grid 701, for example, a 2×2 set of matching elements may qualify for removal from the grid 701.

To create adjacent groups of matching elements, the player may select a first element (e.g., 702D) at a first location in the grid 701 and a second element (e.g., 702E) in a second location in the grid. In one embodiment, the first element (e.g., 702D) is automatically moved to the second location and the second element (e.g., 702E) is automatically moved to the first location when the first element and the second element are selected by the player. In another embodiment, the first element (e.g., 702D) is moved to the second location and the second element (e.g., 702E) is moved to the first location only when the change of locations of the elements (e.g., 702D, 702E) creates an adjacent group of three or more matching elements.

According to one embodiment, elements settle from the top of the grid 701 downward to fill voids created by the removal of elements from the grid 701. For example, if element 702F is moved from the location shown in FIG. 7 to the location occupied by element 702G in FIG. 7, elements 702F, 702H, 702I form an adjacent group of three elements in the same family of elements. Thus, the elements 702F, 702H, 702I may be removed from the interface 701. Upon the removal of elements 702F, 702H, 702I, elements 702J, 702K, 702L each move down to the locations previously occupied by 702F (after it has swapped locations with element 702G), 702H, 702I, respectively. The elements in the column above each of 702J, 702K, 702L also each move down to the position directly below the locations where those elements are located as shown in FIG. 7. As a result of the downward settling of elements in the three columns, a void is created in the positions in the grid 701 that are occupied by elements 702M, 702N, 702O in FIG. 7. In one embodiment, the voids created by the settling are then filled by elements that are newly added to the top of the grid 701.

According to one embodiment, some elements (e.g., 702A, etc.) in the grid 701 include one or more special features. In a version of this embodiment, the element is associated with at least a partial result of the game of chance. For example, an element can be associated with one or more prizes such as extra points, money, added game playing time, a multiplier applied to point totals to increase points, a multiplier applied to the remaining playing time to increase the playing time, other prizes or a combination of two or more of the preceding features. The element can include indicia indicating that the element is associated with a prize and/or at least a partial result of the game of chance. For example, the indicia can provide a visual cue indicating the association to the player. Referring to FIG. 7, for example, element 702P includes indicia 708 (e.g., the letter 's') indicating that it is associated with a prize. The prize is not awarded, however, until the element 702P associated with the prize is removed from the grid 701 by, for example, moving elements such that the element 702P is included in an adjacent group of matching elements.

The presence of indicia 708 with an element (e.g., 702P) does not remove the element from the family of elements that it is associated with. Thus, the element (e.g., 702P) including indicia 708 remains in the family of matching elements even when the remaining family members in an adjacent group of matching elements do not include any such indicia 708.

According to one embodiment, the interface 700 includes a timer 703 employed with the BEJEWELED-type game and, in a version of this embodiment, the game ends when time expires on the timer (e.g., the value of the timer is 0). The timer can be implemented in a variety of formats including a display of numerals as shown in FIG. 7. Other example timers include a timer with a simulated clock face (e.g., an analog clock face with one or more hands, and alternatively, a digital clock face), a timer that appears as bar that shrinks as time elapses during the play of the game, a timer that appears as a circle with a shaded area that decreases as time elapses, or any combination of the preceding or other known symbols and/or animation.

The player can be awarded points, money, other prizes or a combination of one or more types of rewards during play of the game. Thus, in one embodiment, the game can include additional controls and indications. For example, as shown in FIG. 7, the interface 700 may include an indicator 704 indicating the points accumulated by the player during the play of the game. An indicator 705 may also be included to indicate the monetary winnings accumulated by the player during the play of the game.

In addition, the interface 700 may include other indicators and controls that are not shown here. Where, for example, a ticket is associated with multiple game instances of a BEJEWELED-type game, the interface may include an indicator that indicates the remaining game instances that are available on the ticket. Further, the interface 700 may include an indicator that indicates the current winnings on the ticket. The interface may also include any number of miscellaneous indicators and controls, for example, a quit/exit control, a help control, a games-menu control, an audio control, a change ticket control and the like.

Some of the prizes awarded to the player during the play of the BEJEWELED-type game may be items that can be used by the player to play a second level game where prizes are revealed. For example, a player can win spins during play of the BEJEWELED-type game that can be used in a second level slot machine game. In this embodiment, the interface 700 can include an indicator that displays the items awarded to the player for use in the second level game (e.g., spins).

According to one embodiment, the interface 700 includes controls that may be used during the play of the game when selected by the player. For example, the interface 700 may include a control 706 that relocates the elements (e.g., 702A) within the grid 701 when the control 706 is selected by the player. In one embodiment, the locations of the elements (e.g., 702A) are scrambled when the control 706 is selected by the player. In a version of this embodiment, the new locations appear to be randomly selected. The interface may also include a control 707 that provides players with a clue or hint regarding the selection of elements that is available to them. For example, in response to selecting the control 707, a successful move (e.g., a move that creates an adjacent group of matching elements) may be indicated within the interface 700. The successful move may be indicated when an element (e.g., 702A) that can be moved to create the adjacent group of elements is identified in the interface 700, for example, by changing the element's color, shape, brightness, or animating the element in some way (e.g., pulsing, blinking, twinkling).

In one embodiment, the interface 700 includes a control (not shown) that allows the player initiate the play of the game or another instance of the game, or some other game associated with the game of chance. In a version of this embodiment, the control allows the player to select a second-level game.

Figure 8:
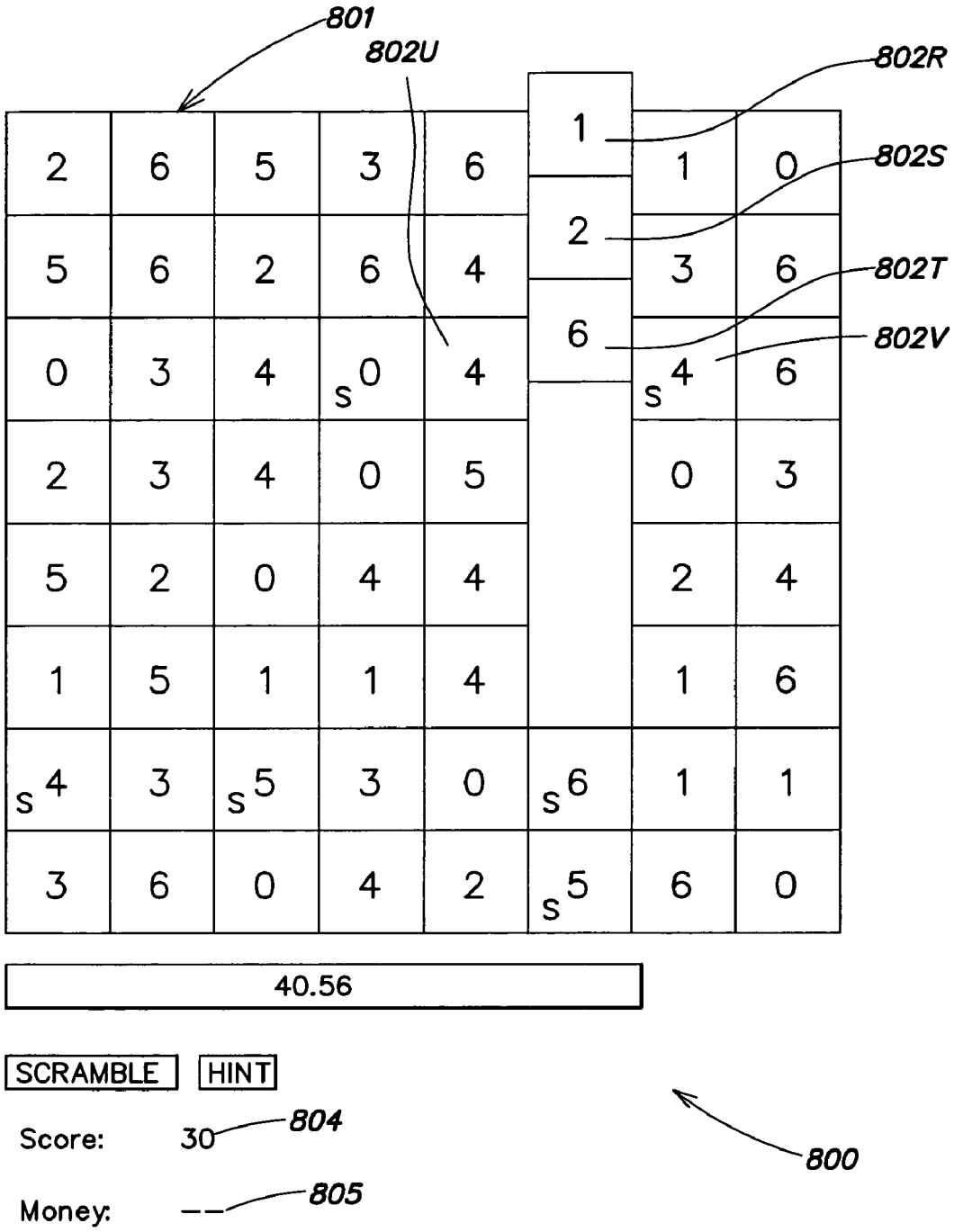
FIG. 8 is another example of a game interface according to another embodiment of the present invention.

Further details regarding play of the game will now be described with reference to FIGS. 8, and 9. FIG. 8 depicts the grid of FIG. 7 following the removal of a plurality of elements from the grid 701. An example transition from the status of the interface 700 shown in FIG. 7 to the status of the interface 800 shown in FIG. 8 occurs at least in part as a result of the selections made by the player during the play of the game. In one embodiment, the player may initiate a switch of positions between the elements 702D and 702E that when complete creates an adjacent group of matching elements. The switch of positions may be initiated by, for example, selecting one element from a pair of elements (e.g., 702D and 702E) and then selecting the previously unselected element 702D or 702E from the pair, i.e., they can be selected in either order. The elements 702D and 702E may then automatically swap locations such that element 702D moves one column to the left and element 702E moves one column to the right.

A selected element may also provide a visual cue (e.g., blinking) that it is selected, until any relocation is complete. The player can use a cursor to click on a first element at a first location and then click on a second element at a second location to initiate a swap whereby the first element is moved to the second location and the second element is moved to the first location. In a version of this embodiment, before the elements 702D, 702E are swapped, a computer-based game playing system evaluates the selection to determine whether the switch of positions results in the formation of a group of adjacent elements in the same family of elements. The system may automatically reject a move that does not form such a group. In one or more embodiments, including embodiments of a computer-based game playing system, the player moves at least one of the two elements 702D, 702E to its new position, for example, by using a cursor to click and drag at least one of the two elements to its new location in the grid 701.

The elements (e.g., 702B, 702C, 702E, 702P, 702Q) located in the newly-formed group of adjacent elements in the same family of elements (e.g., those elements associated with the numeral 5) are then removed from the grid 701 and newly-added elements fill the void as shown in FIG. 8. In the embodiment shown in FIG. 8, the newly-added elements descend downward from the top of the interface 800. Each of the group of five adjacent elements in the same family of elements (e.g., 702B, 702C, 702E, 702P, 702Q) is removed from the grid 801 when the locations of elements 702D, 702E are swapped.

FIG. 8 depicts a point in time following the removal of the five elements, but before the void created by their removal is completely filled, i.e., elements are in the process of descending but have not yet come to rest. Because, in the embodiment shown, voids created by the removal of elements are then filled from above, the element 802T descends from its position at the top of the column from which the five elements were removed to the position formerly occupied by the element 702P. In addition, two of the five elements (e.g., 802R, 802S) to be newly-added as a result of the removal of the elements also appear in the interface 800 shown in FIG. 8. When the addition of the five newly-added elements is complete, the newly-added elements 802R and 802S will replace the elements 702E (after it is moved) and 702Q, respectively, in the grid 801. Two additional elements (not shown) will descend from above the element 802R and replace the elements 702C and 702B.

According to one embodiment, additional elements will be automatically removed if the replacement of the first group of adjacent elements (e.g., 702B, 702C, 702E, 702P, 702Q) results in one or more newly-formed adjacent groups of matching elements. For example, the element that descends immediately above the element 802R will come to rest in the location previously occupied by the element 702C. The elements on either side of the location previously occupied by the element 702C are included in the family of elements associated with the numeral 4, i.e., the elements 802U, 802V. Thus, three additional elements will be removed, without any further selection by the player, if the element that replaces the element 702C is also associated with the numeral 4, e.g., 802U, 802V and the newly-added element replacing 702C will be removed.

The subsequent formation of one or more adjacent groups of matching elements resulting from the replacement of previously removed elements may be referred to as a "chain reaction." As mentioned above, these "chain reactions" result in the further removal of elements from the grid (e.g., 800) before the player selects any additional elements for relocation within the grid. In one embodiment, the value of the elements removed (e.g., 802U, 802V) from the grid in these "chain reactions" increases with each group of adjacent elements that is removed before the player makes another move in the game. That is, the removal of each element is worth more points for the second group of elements that are removed (e.g., 802U, 802V) than it is for the removal of each element in the first group of elements (i.e., the group formed by the player's selection and movement of an element, for example, the movement of the element 702E).

In addition, the number of chain reactions is not limited. Thus, removal of a second group of elements may be immediately followed by the formation and removal of a third group of matching elements with an even greater value. For example, three elements are added as a result of the removal of the elements in the group including the elements 802U, 802V. The resulting replacement of those removed elements may result in yet another adjacent group of matching elements that is formed and then is automatically removed from the grid 801 before the player selects another element.

As mentioned above, in one embodiment, the removal of the adjacent matching elements (e.g., 702B, 702C, 702E, 702P, 702Q) results in the player being awarded points. Points may be awarded based on an amount of points that each element is worth when it is removed from the grid 801. For example, where each element is worth five points the removal of five elements will result in the player being awarded 25 points. As mentioned previously, some elements may be associated with a prize (e.g., 702P). The prize may affect the amount of points awarded for the removal of the element associated with the prize, the amount of points awarded for the removal of all other elements included in the group of adjacent elements removed with the element associated with the prize or both.

In one embodiment, the indicator 804 provides the total quantity of points awarded to the player during the play of the game. Thus, as shown in FIG. 8, the indicator 804 indicates that the player now has thirty points as a result of the removal of the elements 702B, 702C, 702E, 702P, 702Q. Because one of the elements that was removed 702P is associated with a prize, the points awarded for the removal of the group may be increased. In one example, removal of each element from the grid is generally worth five points but the removal of an element associated with extra points (e.g., 702P) is worth ten points. Thus, the removal of the elements 702B, 702C, 702E, 702P, 702Q is worth 30 points with each of the elements 702B, 702C, 702E, 702Q worth five points (20 total points) and the removal of element 702P worth an additional 10 points. As mentioned above, a quantity of points can be displayed with indicator 804. According to one embodiment, the quantity of points displayed with the indicator 804 is a cumulative total that may include all points awarded to the player during a game instance or for a plurality of game instances.

The display of any monetary prizes awarded to the player can be accomplished using the indicator 805 in a manner similar to that described above for the points. That is, the amount of money winnings can be displayed for a game instance or a plurality of game instances. In one embodiment, the amount of money winnings displayed with indicator 805 is a total amount associated with the game of chance.

Figure 9:
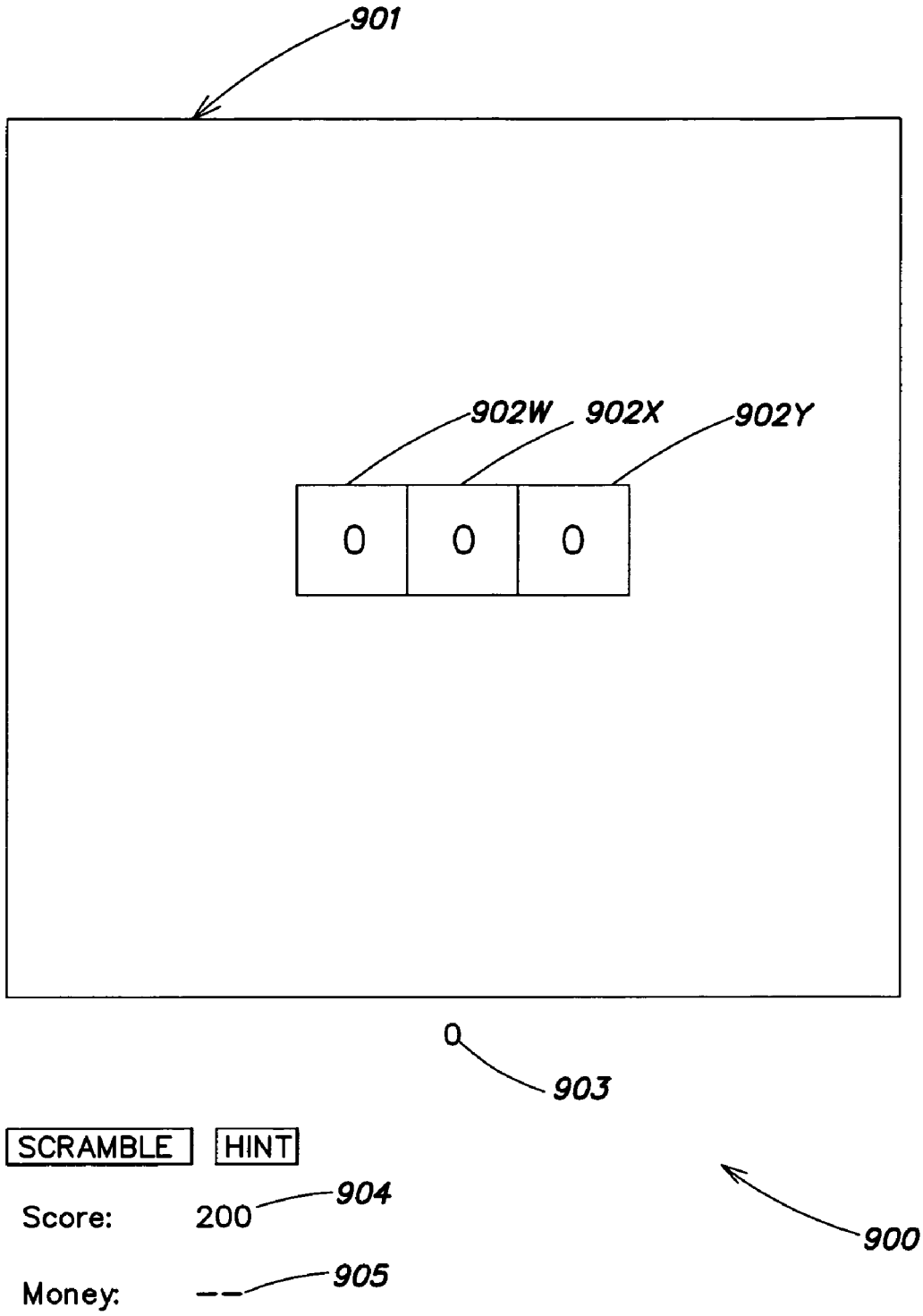
FIG. 9 is another example of a game interface according to another embodiment of the present invention.

Referring to FIG. 9, according to one embodiment, the grid is cleared of elements (e.g., 702A) at the completion of the BEJEWELED-type game or a completion of a game instance of the BEJEWELED-type game (e.g., as indicated when the timer associated with the game or game instance indicates that no time remains for play of the game) provided that the player has previously been awarded (i.e., has revealed during play of the game) all the prizes associated with the game or game instance. According to this embodiment, when the player has not yet revealed the entire prize associated with the game, the grid 901 is cleared except for a subset of matching elements (e.g., 902W, 902X, 902Y). In one version of this embodiment, the subset of matching elements 902W, 802X, 902Y move to the center of the grid in an animated fashion and automatically reveal the previously unrevealed portion of the prize associated with the game or the game instance. This unrevealed portion may be the entire prize or some part of it that the player did not reveal as a result of playing the BEJEWELED-type game.

In one version of this embodiment, one of the elements remaining in the grid is an element associated with the previously unrevealed prize. The element associated with the previously unrevealed prize may include indicia that provide an indication that the element is associated with the prize. Such an element may provide an indication that is associated with a prize by changing color, shape, or brightness or any combination of these features. Further, an element associated with a prize may appear in the grid 901 during the play of the game as described above or at the conclusion of the game or game instance in an animated fashion that can include pulsing, blinking, twinkling or any combination of these features and the previously listed features.

In one embodiment, at the conclusion of the game or the game instance, the interface 900 may include a timer 903 that indicates that there is no additional time left for play of the game or game instance. The total amount of points awarded and the total amount of prize money awarded during the play of the game or game instance can also be displayed with the indicators 904, 905, respectively. In a version of this embodiment, the newly-revealed prizes will be added to the totals shown by indicators 904, 905 when the matching subset of elements (e.g., 902W, 902X, 902Y) are removed from the grid 901.

As mentioned above, although the BEJEWELED-type game can be played as a single level game, a second level of the game may also be played with items collected during the BEJEWELED-type game. Also, as discussed, these items may be hidden within elements of the grid (e.g., grid 701) and released as elements are removed. In one version of the game, items such as spins of a wheel or sticks of dynamite (a.k.a. "hotsticks") are located within elements in the grid. Items (spins, sticks, etc.) are accumulated and used in the second reveal-type game to reveal a payout or other type of prize. The interface 701 may include an indicator that identifies the quantity of items (e.g., spins) that are awarded during the play of the BEJEWELED-type game for use in the second level game.

In the example game discussed above having one or more elements containing hidden items (e.g., safes), sticks of dynamite or other items collected may be used to uncover the hidden prizes in the second level portion of the game. For instance, winnings (e.g., cash prizes) revealed within opened safe elements are awarded to the player. In one example, the reveal of the number of sticks awarded to a player may be randomized by the client computer, with at least one stick awarded to the player to allow the player to open at least one safe.

As discussed previously with reference to the game of COLLAPSE, game play may be returned to another instance of the first level game (e.g., the BEJEWELED-type game) after play of the second level game. The player may, however, choose to play a different game (e.g., a card game or other game) at the conclusion of any particular game instance. The player may be permitted to play further instances of the BEJEWELED-type game, with each level of the BEJEWELED-type game leading to a second level wherein prizes are revealed. These intermediate prize amounts that are revealed with each instance of the BEJEWELED-type game, as discussed above, may be stored in a database of the server, and provided to the client prior to or during game play. Alternatively, intermediate prize amounts may be determined at the client in a random manner (e.g., by randomly selecting a possible combination of intermediate prize amounts that total the overall prize awarded to the player). In another example, a game may be determined dynamically by the game system or client based on one or more rules. These rules may be tailored so that the overall result is revealed by the game system in an interesting way.

For instance, the ticket may have an overall prize value of $50, and the prize awarded at each instance of the BEJEWELED-type game may accumulate to form the $50 prize. There may be a finite number of combinations based on the number of game instances to achieve a $50 prize, and the actual game experience presented to the player may be a random selection of the finite outcomes. In any case, the result of each game instance is either stored at the server or is determined randomly or dynamically by the client as discussed above.

According to one embodiment of the present invention, a BEJEWELED-type game is conducted that may include the following additional features and functionality, either alone or in combination:

- A player is presented with an 8×8 group of elements (e.g., gems) in a grid displayed within an interface.
- Gems located adjacent to one another are swapped to form lines or rows of three or more of the same gem.
- The player selects a first gem (e.g., clicks on the gem when a cursor is moved to the location of the first gem) and the selected gem changes in appearance to provide an indication that the gem is selected.
- If the player then selects a second gem in a location adjacent to the first gem, the second gem swaps locations with the first gem if the swap results in the formation of a row or line of three or more like-gems (e.g., gems from the same family of gems), however, the gems will automatically move back to their original locations, if the swap does not result in the formation of an adjacent group of three or more like-gems.
- If the second gem selected is not located adjacent the first gem, the first gem is deselected, i.e., the gem returns to its original appearance.

Gems are removed from the interface when matches of three or more gems are made (i.e., an adjacent group of matching gems is formed) and points are earned when matches are made.

An indicator in the interface displays the point total for matches.

When matches are made, the remaining gems in the grid settle downward to fill the void and new gems fall in from the top.

Further matches may be made when the gems settle downward (i.e., "chain reactions" are created) and these further matches earn progressively more points for the player.

The game is timed and the interface may include a game timer which indicates how much time is left in the game.

Different families (e.g., seven different families) of gems can be used in the game where the gems in each family have a unique shape and color, and the gem families include a dark-green emerald, a bluish-white diamond, a white pearl, a gold nugget, a red garnet, a purple amethyst, and a vivid-orange fire opal.

The game includes special gems that may be from any of the family of gems and include a visual cue that indicates that the gem is somehow different or special.

When a special gem is included in a matched set of adjacent gems it is cleared with the set, for example, a "special" diamond is cleared with two or more diamonds.

Clearing a special gem reveals a reward of some type, for example, prize money, a multiplier that multiplies the points earned for the match, a multiplier-timer that includes a multiplier value associated with it such that any matches made while the timer is active are increased by the multiplier, or the addition of extra time to the timer.

Rewards associated with the special gem may be revealed, for example, by appearing in a treasure chest that opens to reveal the prize which is then added to the indicator, a multiplier may appear next to the indicator for points, a multiplier timer may enlarge in size and move next to the points tally and then disappear when the time on the timer expires, and extra time may appear as a clock adjacent the game timer where it will then merge into the game timer to increase the amount of game time remaining.

The interface may include a message explaining to the player that the removal of special gems may reveal cash prizes or special bonuses.

The interface may include a "Hint" control (e.g., a button) that can be selected by the player an unlimited number of times during the play of the game whereby selection of the hint button prompts the game to show the player a move that they can make, for example, two gems that can be swapped may glow and pulse.

The interface may include a "Scramble" control (e.g., a button) whereby selection of the scramble button by the player causes all the gems on the board to scramble and move to a different location in the grid in an animated fashion. Groups of adjacent matching gems formed as a result of the scramble will be removed from the board and the player will be awarded the corresponding number of points. The Scramble button may also be selected an unlimited number of times during the play of the game.

The game is over when the game timer runs out (e.g., reaches zero). A treasure chest is associated with the game timer such that the gems move from the grid to the treasure chest when the timer reaches zero. (In addition, the gems could fly out of the treasure chest to populate the grid at the start of the game.) For a player who has revealed their entire prize during the game, all the gems will move to the chest and the "Game Over" message is displayed. For a player who has not revealed their entire prize during the game, all but three gems move to the chest. The three remaining gems are matching gems and include a special gem among them. The gems vibrate and then explode to reveal the players prize amount. Amer the prize amount is revealed, the "Game Over" message is displayed.

According to one aspect of the present invention, it is realized that the time at which tickets are activated (and therefore, may be played) is important. In the case of a casino-based game, where tickets are issued at the casino, it may be beneficial to include a delay between the purchase of a ticket and a possible redemption of the ticket so that the game play associated with the ticket does not compete against other games offered by the casino (e.g., floor games). For example, in the case of a slot machine game, it may be preferable that such a game be activated after the player leaves the casino, or otherwise is not playable while in the casino so as not to compete with other types of slot machine games or other game types offered by the casino.

Further, another benefit of introducing a delay between ticket issuance and activation includes increasing the likelihood that the player plays the game at another location (e.g., at home), requiring the return of the player to the ticket redemption location to redeem his/her winnings. Because the player needs to return to the redemption location (which may be a casino), the possibility that the player will purchase additional tickets or play other types of games offered at the redemption location is increased.

Having thus described several aspects of at least one embodiment of this invention, it is to be appreciated that various alterations, modifications and improvements will readily occur to those skilled in the art. Such alterations, modifications, and improvements are intended to be part of this disclosure, and are intended to be within the spirit and scope of the invention. Accordingly, the foregoing description is by way of example only.

What is claimed is:

1. A method for playing a game of chance comprising acts of:

issuing a ticket associated with the game of chance to a player, the ticket including a code printed on a surface of the ticket;

assigning a result of the game of chance to the code after the issuance of the ticket, the result of the game of chance driven by an outcome of a first game, wherein the outcome of the first game is determined by a drawing;

providing for the player to play another game on a different medium than the issued ticket;

wherein conducting the another game comprises acts of:

providing a plurality of elements arranged in a grid;

associating, with at least one of the elements, at least one result;

providing for a selection, by the player, to exchange at least two elements adjacent to each other among the plurality of elements;

removing three or more similar elements arranged linearly within the grid; and revealing the at least one result associated with the play of the another game; and during play of the another game, awarding the player with an additional opportunity to reveal results of the game of chance outside of the another game.

2. The method according to claim 1, wherein at least one of the three or more similar elements each share a common characteristic.

3. The method according to claim 1, further comprising an act of revealing results of the game of chance to the player, wherein the code is used to gain security access to the results of the game of chance, and wherein the code is used to gain security access to play the another game.

4. The method according to claim 1, further comprising an act of revealing the at least one result to the player when the at least one of the elements associated with the at least one result is removed.

5. The method according to claim 1, further comprising an act of moving an element selected by the player to a location within the grid selected by the player.

6. The method according to claim 5, wherein the location is adjacent to at least one location occupied by an element that shares a common characteristic with the element selected by the player.

7. The method according to claim 1, wherein the three or more similar elements are matching elements.

8. The method according to claim 1, further comprising acts:

permitting the player to select a first element displayed in a first location in the grid;

permitting the player to select a second element displayed in a second location in the grid; and displaying the first element in the second location and displaying the second element in the first location following a selection of the first element and a selection of the second element by the player.

9. The method according to claim 1, wherein the another game is a computer-based game and the different medium is a computer.

10. The method according to claim 9, wherein the at least one result is at least a partial result of the game of chance.

11. The method according to claim 10, wherein the at least one of the elements associated with the at least one result includes indicia indicating that the at least one of the elements is associated with the at least partial result of the game of chance.

12. The method according to claim 10, further comprising an act of revealing the at least partial result of the game of chance when the at least one of the elements associated with the at least one result is removed from the grid.

13. The method according to claim 12, wherein the at least one of the elements associated with the at least one result is included in the three or more similar elements.

14. The method according to claim 11, wherein the at least partial result is an amount of prize money.

15. The method according to claim 14, wherein the at least partial result is a total amount of prize money associated with a game instance of the another game.

16. The method according to claim 11, wherein the results of the game of chance include points.

17. The method according to claim 16, wherein the at least partial result is one of a multiplier used to multiply a point total accumulated by the player.

18. The method according to claim 9, further comprising an act of, upon completion of a game instance of the another game, clearing the grid of all elements except for a subset of matching elements and providing for the subset of matching elements to reveal at least a partial result of the game of chance.

19. The method according to claim 9, further comprising acts of:

permitting the player to select both a first element located at a first location within the grid and a second element located at a second location within the grid; and moving the first element to the second location and moving the second element to the first location following a selection of the first element and the second element.

20. The method according to claim 19, wherein at least one of the first element and the second element are included among the three or more similar elements.

21. The method of claim 20, wherein the three or more similar elements are arranged linearly in one of a column and a row in the grid.

22. The method according to claim 20, wherein at least one of the three or more similar elements is associated with a prize, and wherein the method further comprises an act of awarding the prize to the player.

23. The method according to claim 22, further comprising an act of associating the prize with a corresponding pay table entry.

24. The method according to claim 22, wherein the prize awarded to the player is predetermined.

25. The method according to claim 22, wherein an act of removing an element associated with the prize is independent of an act of determining the prize awarded by the act of awarding.

26. The method according to claim 22, wherein the computer-based game is timed, and wherein the act of awarding the prize to the player comprises an act of adding playing time to the game.

27. The method according to claim 22, wherein the player is awarded points when an element is removed from within the interface, and wherein the act of awarding the prize to the player comprises an act of increasing a point total of the player.

28. The method according to claim 22, wherein, prior to the act of selecting, an element associated with the prize includes a visual indication that it is associated with the prize.

29. The method according to claim 9, further comprising an act of awarding to the player an item for use in a second level game.

30. The method according to claim 29, wherein the item for use in the second level game is used by the player to play the second level game, and wherein the item is used to reveal a prize won by the player.

31. The method according to claim 29, wherein the item for use in the second level game is a spin provided in the another game, and wherein the method further comprises acts of:

permitting the player, in the second level game, to spin a slot machine game, the slot machine game having an associated pay table;

determining and displaying an outcome of the slot machine game; and awarding a prize to the player if the slot machine outcome matches at least one entry of the associated pay table.

32. The method according to claim 1, wherein the act of providing the player with the additional opportunity comprises an act of providing a separate game in which the player reveals results of the game of chance.

33. The method according to claim 32, wherein the act of providing a separate game comprises an act of providing a number matching game, and wherein the method further comprises acts of:

associating one or more numbers with the player;

associating one or more numbers with a win opportunity; and determining whether the one or more numbers associated with the player match the one or more numbers associated with the win opportunity.

* * * * *